US012337254B2

(12) United States Patent
Marvin et al.

(10) Patent No.: US 12,337,254 B2
(45) Date of Patent: Jun. 24, 2025

(54) APPARATUS FOR A TOY

(71) Applicant: Hasbro, Inc., Pawtucket, RI (US)

(72) Inventors: Nicholas Marvin, Potsdam, NY (US); Spencer Roberts, North Providence, RI (US)

(73) Assignee: Hasbro, Inc., Pawtucket, RI (US)

( * ) Notice: Subject to any disclaimer, the term of this patent is extended or adjusted under 35 U.S.C. 154(b) by 328 days.

(21) Appl. No.: 17/103,291

(22) Filed: Nov. 24, 2020

(65) Prior Publication Data

US 2021/0187403 A1 Jun. 24, 2021

Related U.S. Application Data

(60) Provisional application No. 62/951,254, filed on Dec. 20, 2019.

(51) Int. Cl.
*A63H 3/40* (2006.01)
*A63H 33/00* (2006.01)

(52) U.S. Cl.
CPC ..... *A63H 3/40* (2013.01); *A63H 33/003* (2013.01)

(58) Field of Classification Search
CPC ... A63H 3/38; A63H 3/40; A63H 3/42; A63H 3/48; A63H 33/003; A63H 33/004
See application file for complete search history.

(56) References Cited

U.S. PATENT DOCUMENTS 2,241,389 A * 5/1941 Berman ..... A45B 13/00 135/37
3,905,130 A * 9/1975 Gordon ..... G09B 23/32 446/175
4,245,428 A * 1/1981 Bowen ..... A63H 13/16 156/61
4,499,678 A * 2/1985 Moreau ..... A63H 3/48 446/72
6,811,461 B2 11/2004 Maddocks et al.
7,485,025 B2 2/2009 Schnuckle
7,641,535 B2 1/2010 Maddocks et al.
(Continued)

FOREIGN PATENT DOCUMENTS

WO WO-2007118106 A1 * 10/2007 ..... A63H 3/005
WO 2010071920 A1 7/2010

OTHER PUBLICATIONS

Seung Hoon Bahng, Korean Intellectual Property Office, International Search Report and Written Opinion, corresponding PCT Application No. PCT/US2020/062001, mailed Mar. 18, 2021, 14 pages total.

*Primary Examiner* — Eugene L Kim
*Assistant Examiner* — Alyssa M Hylinski
(74) *Attorney, Agent, or Firm* — DiBerardino McGovern IP Group LLC

(57) ABSTRACT

An apparatus includes: a foldable material including a first portion and a second portion, the second portion at least partially surrounding the first portion; an inner connection structure; and an outer connection structure. The inner connection structure is configured to rotate relative to the outer connection structure; at least part of the first portion of the foldable material is attached to the inner connection structure and at least part of the second portion of the foldable material is attached to the outer connection structure; and the foldable material changes shape when the inner connection structure rotates relative to the outer connection structure.

26 Claims, 15 Drawing Sheets

(56) References Cited

U.S. PATENT DOCUMENTS

| | | | | |
|---|---|---|---|---|
| 7,993,181 | B2 | 8/2011 | Lee et al. | |
| 8,083,567 | B2 * | 12/2011 | Su | G09B 23/30 446/389 |
| 8,083,794 | B2 | 12/2011 | Liu | |
| 8,157,861 | B2 | 4/2012 | Su | |
| 8,162,714 | B2 | 4/2012 | Yang | |
| 8,202,138 | B2 * | 6/2012 | Lai | A63H 3/40 446/389 |
| 8,210,917 | B2 | 7/2012 | Sip et al. | |
| 8,298,037 | B2 | 10/2012 | Sip | |
| 8,333,635 | B2 | 12/2012 | Su | |
| 8,337,272 | B2 | 12/2012 | Su | |
| 8,382,552 | B2 | 2/2013 | Su | |
| 8,562,676 | B2 | 10/2013 | Liu | |
| 2010/0003892 | A1 * | 1/2010 | Chang | A63H 3/38 446/392 |
| 2010/0029171 | A1 | 2/2010 | Su | |
| 2010/0105279 | A1 | 4/2010 | Chu et al. | |
| 2010/0112895 | A1 * | 5/2010 | Su | A63H 3/40 446/392 |
| 2010/0120326 | A1 * | 5/2010 | Lai | A63H 3/40 446/343 |
| 2010/0136878 | A1 | 6/2010 | Su | |
| 2010/0136880 | A1 | 6/2010 | Liu | |
| 2010/0145443 | A1 * | 6/2010 | Su | A61F 2/141 623/4.1 |
| 2010/0330870 | A1 * | 12/2010 | Chen | A63H 3/40 446/343 |
| 2013/0178982 | A1 | 7/2013 | Wong et al. | |

* cited by examiner

APPARATUS FOR A TOY

CROSS-REFERENCE TO RELATED APPLICATION

This application claims the benefit of U.S. Provisional Application No. 62/951,254, filed on Dec. 20, 2019 and titled APPARATUS FOR A TOY, which is incorporated herein by reference in its entirety.

TECHNICAL FIELD

This disclosure relates to an apparatus for a toy. The apparatus includes a foldable material.

BACKGROUND

Persons of all ages enjoy playing with toys.

SUMMARY

In one aspect, an apparatus includes: a foldable material including a first portion and a second portion, the second portion at least partially surrounding the first portion; an inner connection structure; and an outer connection structure. The inner connection structure is configured to rotate relative to the outer connection structure; at least part of the first portion of the foldable material is attached to the inner connection structure and at least part of the second portion of the foldable material is attached to the outer connection structure; and the foldable material changes shape when the inner connection structure rotates relative to the outer connection structure.

Implementations may include one or more of the following features.

A central region of the first portion may be attached to the inner connection structure, and an outer edge of the second portion may be attached to the outer connection structure.

The inner connection structure may have a rotational range of motion from a first position to a second position. The inner connection structure may be configured to rotate from the second position to the first position in a first direction and the inner connection structure may be configured to rotate from the first position to the second position in a second direction. The first portion of the foldable material may be attached to an end of the inner connection structure, and the inner connection structure may be recessed relative to the outer connection structure such that a recessed region exists at the end of the inner connection structure, and the first portion is drawn into the recessed region when the inner connection structure is rotated in the first direction. The foldable material may not be visible when the inner connection structure is at the first position. At least some of the first portion of the foldable material may be visible when the inner connection structure is at the first position. The foldable material may change shape by folding. In some implementations, the foldable material forms one or more folds only when the inner connection structure is not at the second position, and the foldable material does not include any folds when the inner connection structure is at the second position. The foldable material may include one or more pre-formed fold regions, and the foldable material may fold along the one or more pre-formed fold regions. One or more folds may be pre-formed in the foldable material prior to attaching the foldable material to the inner connection structure, and additional folding or unfolding may occur when the inner connection structure rotates relative.

The inner connection structure may include a rod mechanically coupled to a driving mechanism. The outer connection structure may include a sidewall that extends along a longitudinal axis, and a curved surface at one end of the sidewall. The curved surface may define a central region, and the curved surface may have a tangent that is perpendicular to the sidewall. The rod may extend into the central region of the curved surface and may be recessed from the tangent. The foldable material may contact the curved surface. The outer portion of the foldable material may be attached to the sidewall, and the inner portion of the foldable material may be attached to the rod.

The outer connection structure may include an annulus. The inner connection structure may be surrounded by the annulus, and the outer connection structure may be concentric with the inner connection structure.

The foldable material may change shape by folding. The foldable material may fold only after the inner connection structure is rotated relative to the outer connection structure. The foldable material may include one or more pre-formed fold regions that are formed in the foldable material prior to attaching the foldable material to the inner connection structure, and the foldable material may fold along the fold regions.

The apparatus may be a replica eye for a toy. The first portion may be a pupil portion, and the second portion may be an iris portion. The pupil portion may be a first color and the iris portion may be a second color.

The foldable material may have a first amount of flexibility in a first direction and a second amount of flexibility in a second direction that is orthogonal to the first direction. A ratio of the first amount of flexibility to the second amount of flexibility may be between 1 and 2.

The first portion of the foldable material may be attached to the inner connection structure with a first securing apparatus, and the second portion of the foldable material may be attached to the outer connection structure with a second securing apparatus. The first securing apparatus may include an adhesive or a mechanical connector, and the second securing apparatus may include an adhesive or a mechanical connector.

The apparatus may include a cover that is attached to the outer connection structure at a peripheral region of the outer connection structure. The cover may extend over the outer connection structure, the inner connection structure, and the foldable fabric.

The apparatus may include a motor configured to rotate the inner connection structure in the first direction or the second direction. The motor may include a shaft that is attached to the inner connection structure. The motor may be configured to rotate the shaft to thereby rotate the inner connection structure.

The apparatus may include a housing attached to the outer connection structure, and the inner connection structure may be within the housing.

The foldable material may include a woven fabric material.

The foldable material may include a non-woven material. The non-woven material may include an elastic material. The non-woven material may include paper.

The foldable material may include a flexible material.

The second portion may change shape when the inner connection structure rotates relative to the outer connection structure.

In another aspect, an apparatus for a toy includes: a pliable material; an outer connection structure; and an inner connection structure configured to move relative to the outer connection structure. An outer region of the pliable material is attached to the outer connection structure, an inner region of the pliable material is attached to the inner connection structure, and the pliable material changes shape when the inner connection structure moves relative to the outer connection structure.

Implementations may include one or more of the following features.

The pliable material may include a foldable fabric, and the inner connection structure may be configured to rotate relative to the outer connection structure. The foldable fabric may change shape by folding or unfolding when the inner connection structure rotates. The foldable fabric may change shape by the inner region expanding or contracting when the inner connection structure rotates. The foldable fabric may be flexible.

The inner connection structure may be configured to translate relative to the outer connection structure in a first direction and a second direction that is opposite the first direction, and the first and second directions may be substantially perpendicular to a surface tangent of the outer connection structure. The pliable material may be pulled into a recessed region at an end of the inner connection structure when the inner connection structure moves in the second direction to thereby change the shape of the pliable material. The pliable material may be a single piece of a flexible fabric.

The pliable material may be a single piece of a flexible fabric.

In another aspect, a toy includes: a body; an activation feature on the body; and one or more apparatuses. Each apparatus includes: a foldable material including a first portion and a second portion, the second portion at least partially surrounding the first portion; an inner connection structure coupled to the activation feature; and an outer connection structure. The inner connection structure is configured to rotate relative to the outer connection structure in response to movement of the activation feature. At least part of the first portion of the foldable material is attached to the inner connection structure and at least part of the second portion of the foldable material is attached to the outer connection structure. The foldable material changes shape when the inner connection structure rotates relative to the outer connection structure.

Implementations may include one or more of the following features.

The toy may include a doll including a face portion and at least two apparatuses. The at least two apparatuses may include at least a first apparatus and a second apparatus on the face portion of the doll. The first apparatus may be a first eye, and the second apparatus may be a second eye. The first portion of the foldable material of the first apparatus may be a pupil portion of the first eye, the first portion of the foldable material of the second apparatus may be a pupil portion of the second eye, and the first portions of the foldable material of the first and second apparatuses may change shape by expanding or contracting in unison in response to movement of the activation feature. The doll may include a plurality of appendages, and one of the appendages may be the activation feature. The inner connection structure may be coupled to the activation feature by a gear system.

The first portion of the foldable material may include a design that is revealed or hidden by rotating the inner connection structure relative to the outer connection structure.

The foldable material may be on an exterior surface of the body, and the inner connection structure may be inside the body.

The techniques discussed herein may be implemented as a toy figure, a toy set that includes a toy figure, or a method of manufacturing or using a toy figure.

DRAWING DESCRIPTION

Figure 5A:
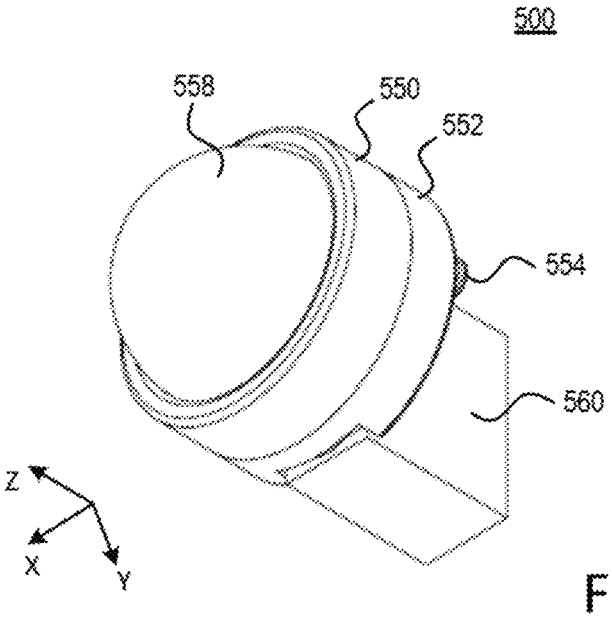
FIG. 5A is a perspective view of an exterior of another apparatus.
Figure 5B:
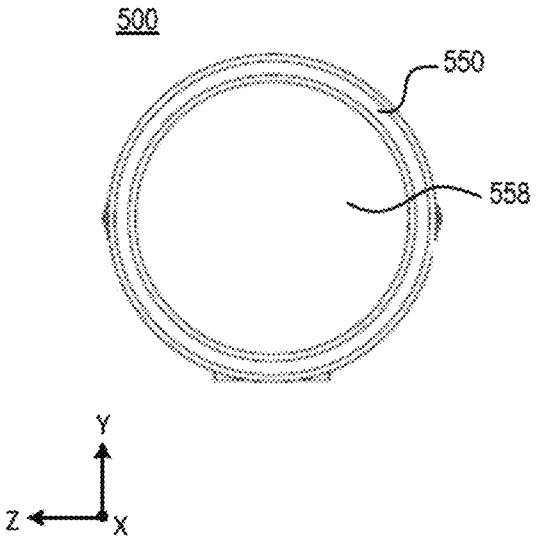
FIG. 5B is a front view of the apparatus of FIG. 5A.
Figure 5C:
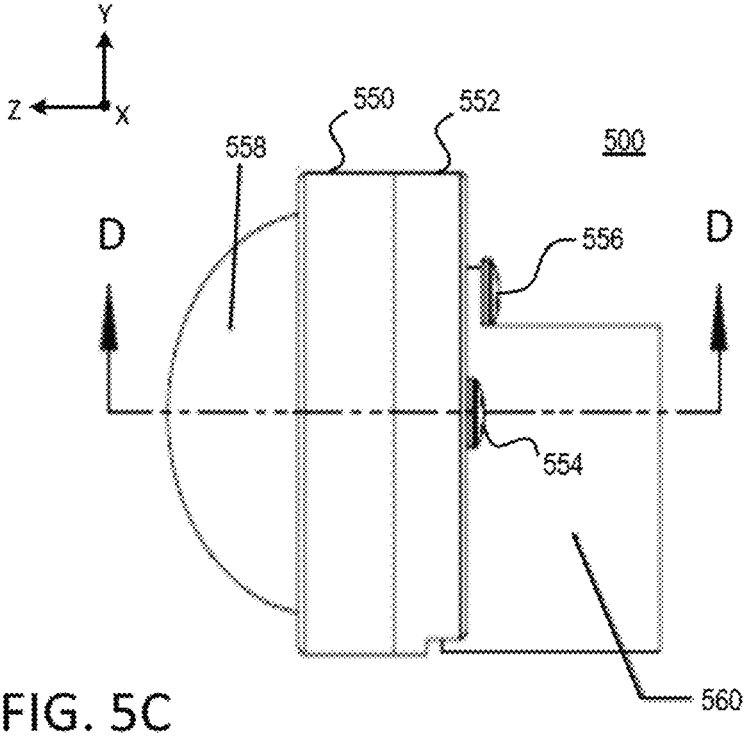
FIG. 5C is a side view of the exterior of the apparatus of FIG. 5A.
Figure 5D:
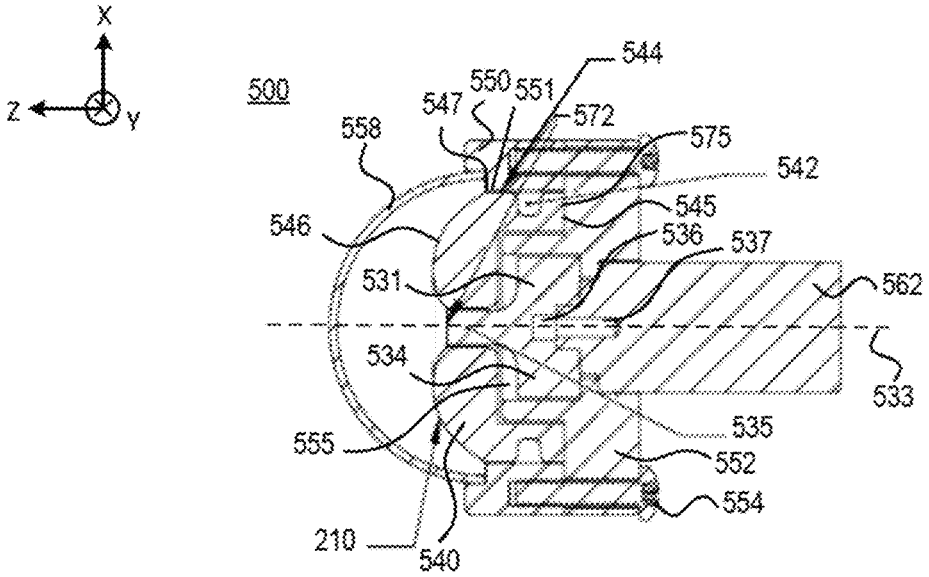
FIG. 5D is a side cross-sectional view of the apparatus taken along the line D-D of FIG. 5C.
Figure 5E:
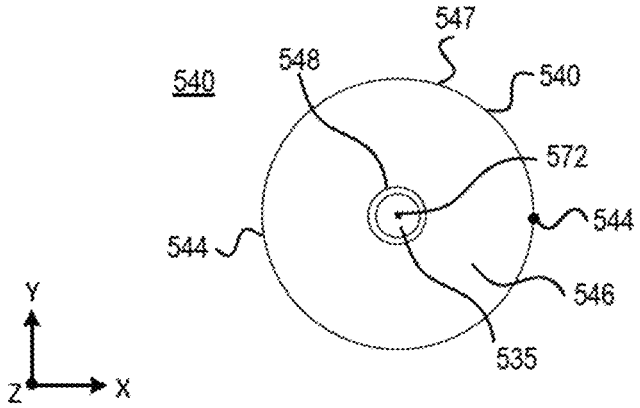
FIG. 5E is a block diagram of a front cross-sectional view of an outer connection structure and an inner connection structure of the apparatus of FIG. 5A.
Figure 5F:
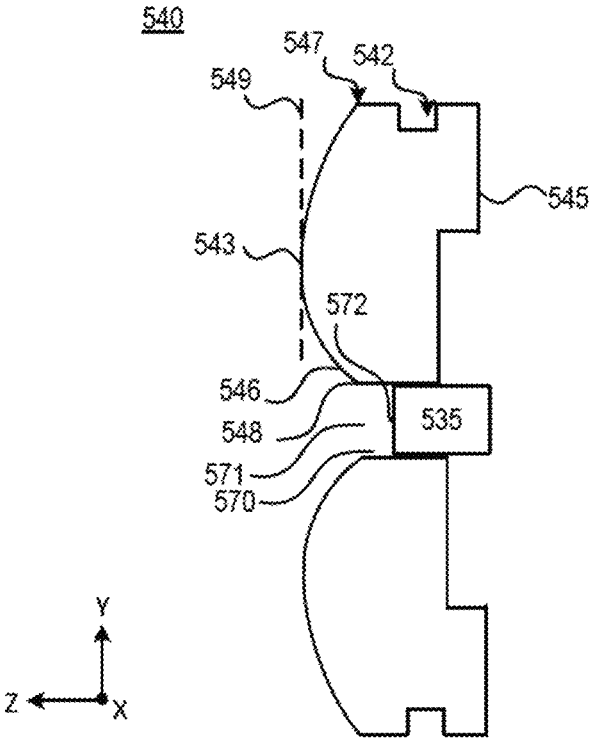
FIG. 5F is a block diagram of a side cross-sectional view of the outer connection structure and an end of the apparatus of FIG. 5A.
Figure 5G:
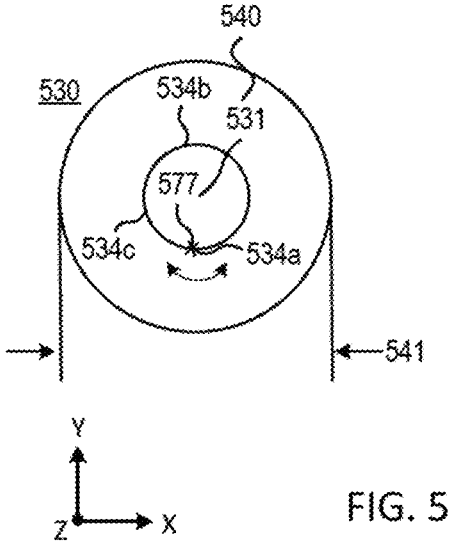
FIG. 5G is a block diagram of a front view of a support structure of the apparatus of FIG. 5A.
Figure 5H:
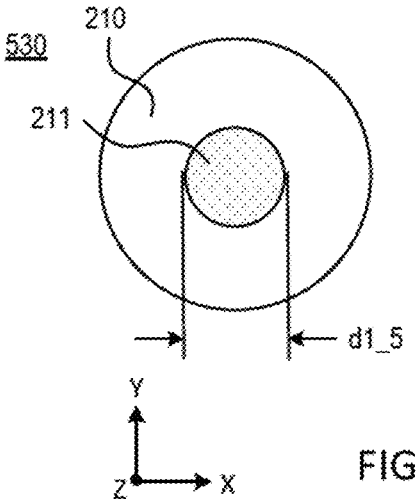
Figure 5I:
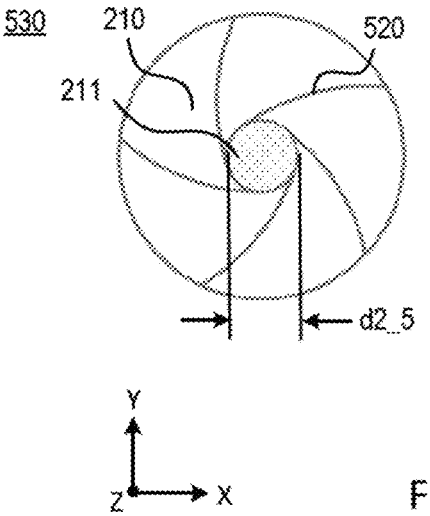
Figure 5J:
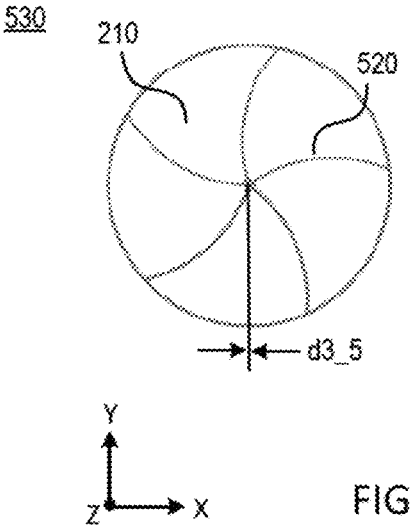

FIGS. 5H, 5I, and 5J are a block diagram of a front view of the support structure of FIG. 5G.

Figure 6A:
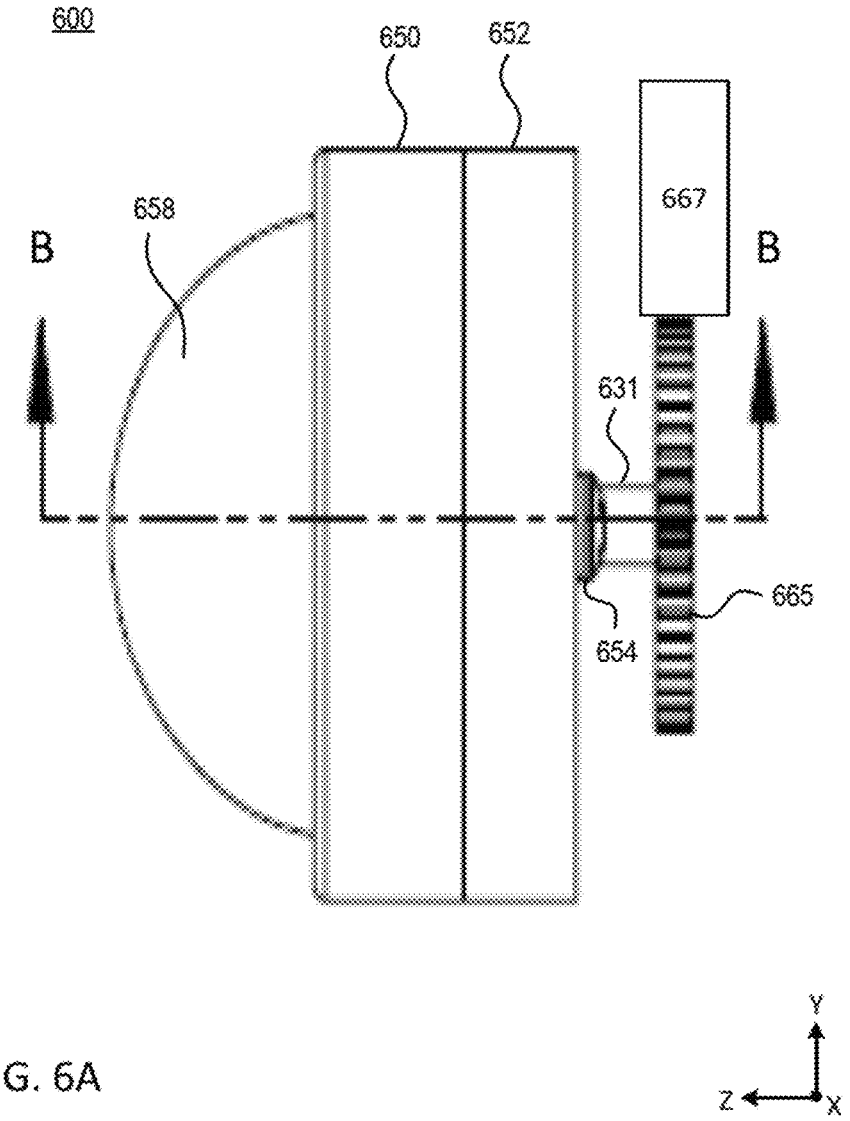

FIG. 6A is a side view of the exterior of another apparatus.

Figure 6B:
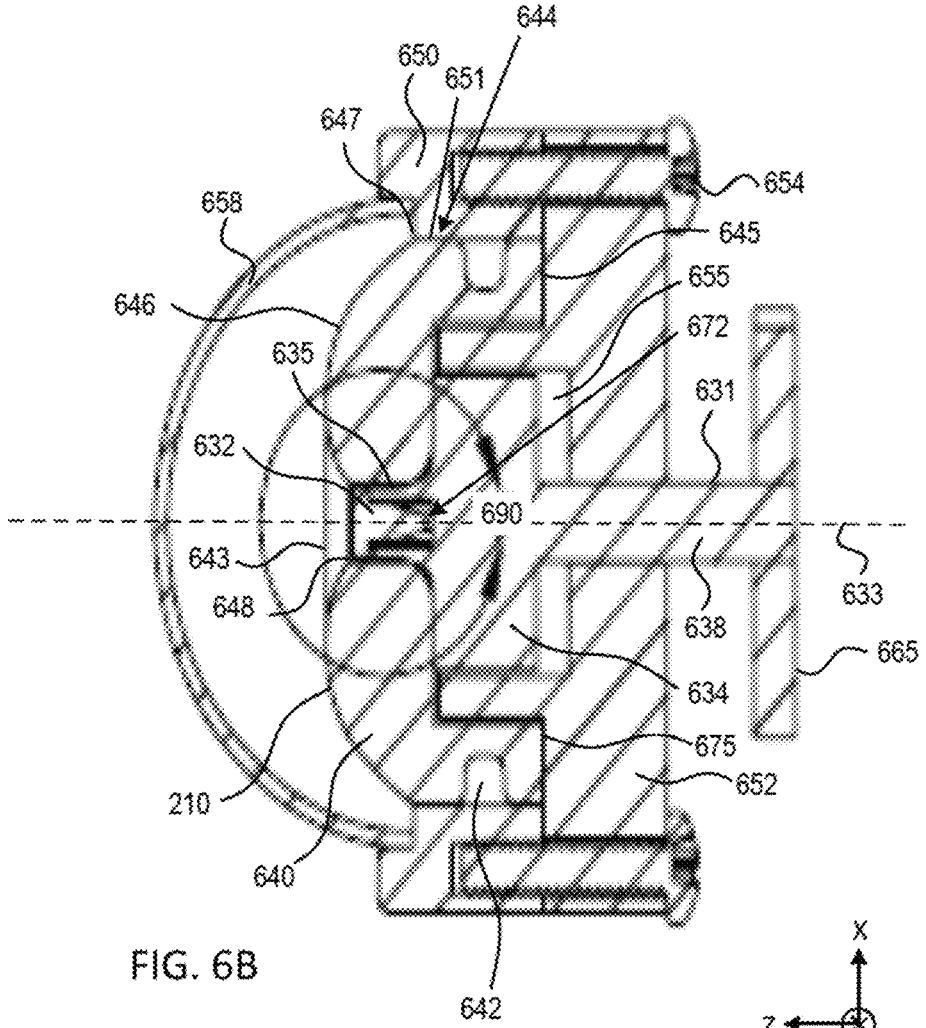

FIG. 6B is a side cross-sectional view of the apparatus of FIG. 6A taken along the line B-B of FIG. 6A.

Figure 6C:
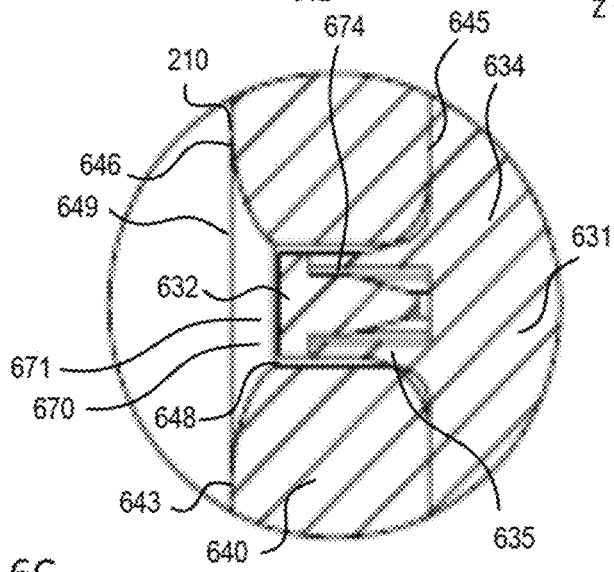
Figure 6D:
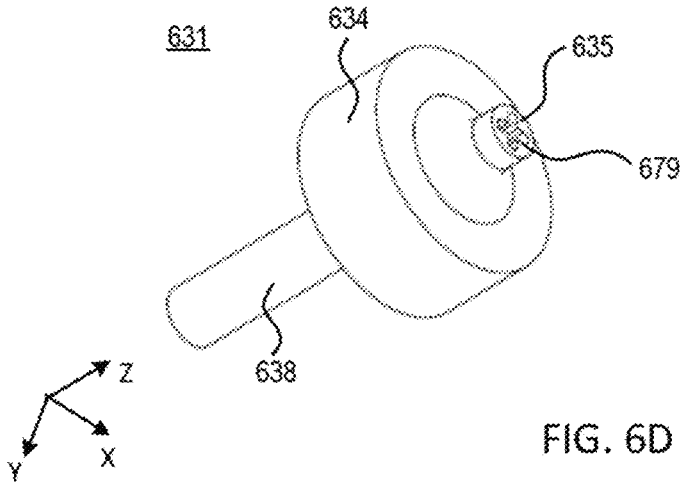

FIG. 6C is a side cross-sectional view of an inset labeled in FIG. 6B FIG. 6D is a perspective view of an inner connection structure of FIG. 6B.

Figure 6E:
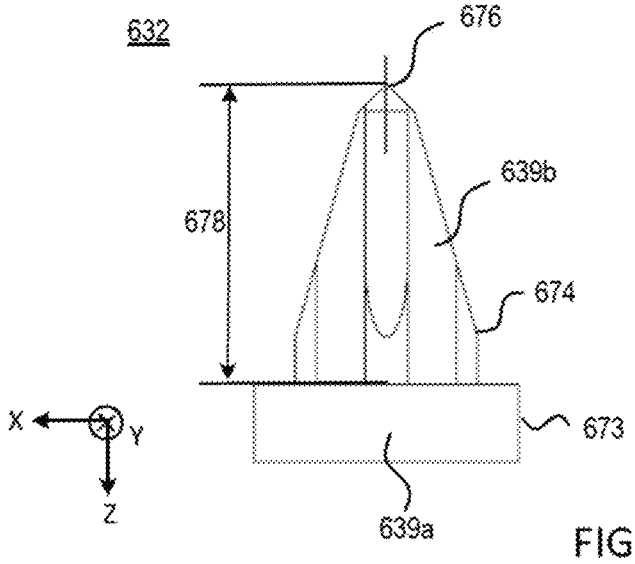

FIG. 6E is a side view of the exterior of a peg of FIG. 6B.

Figure 6F:
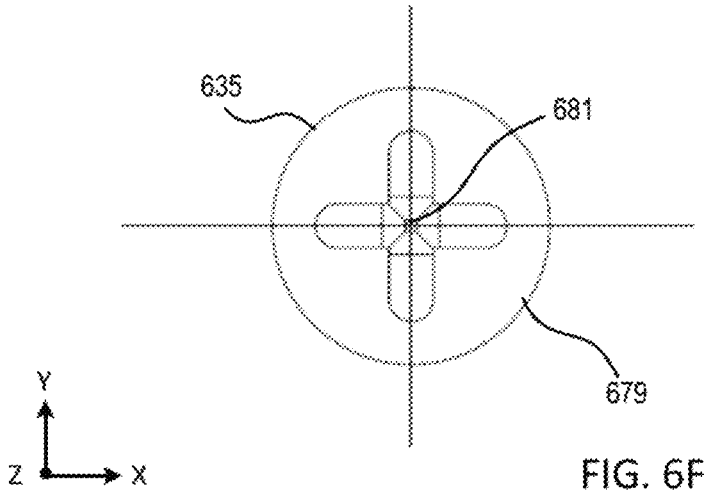

FIG. 6F is a top view of the exterior of an end of the inner connection structure of FIG. 6D.

Figure 7A:
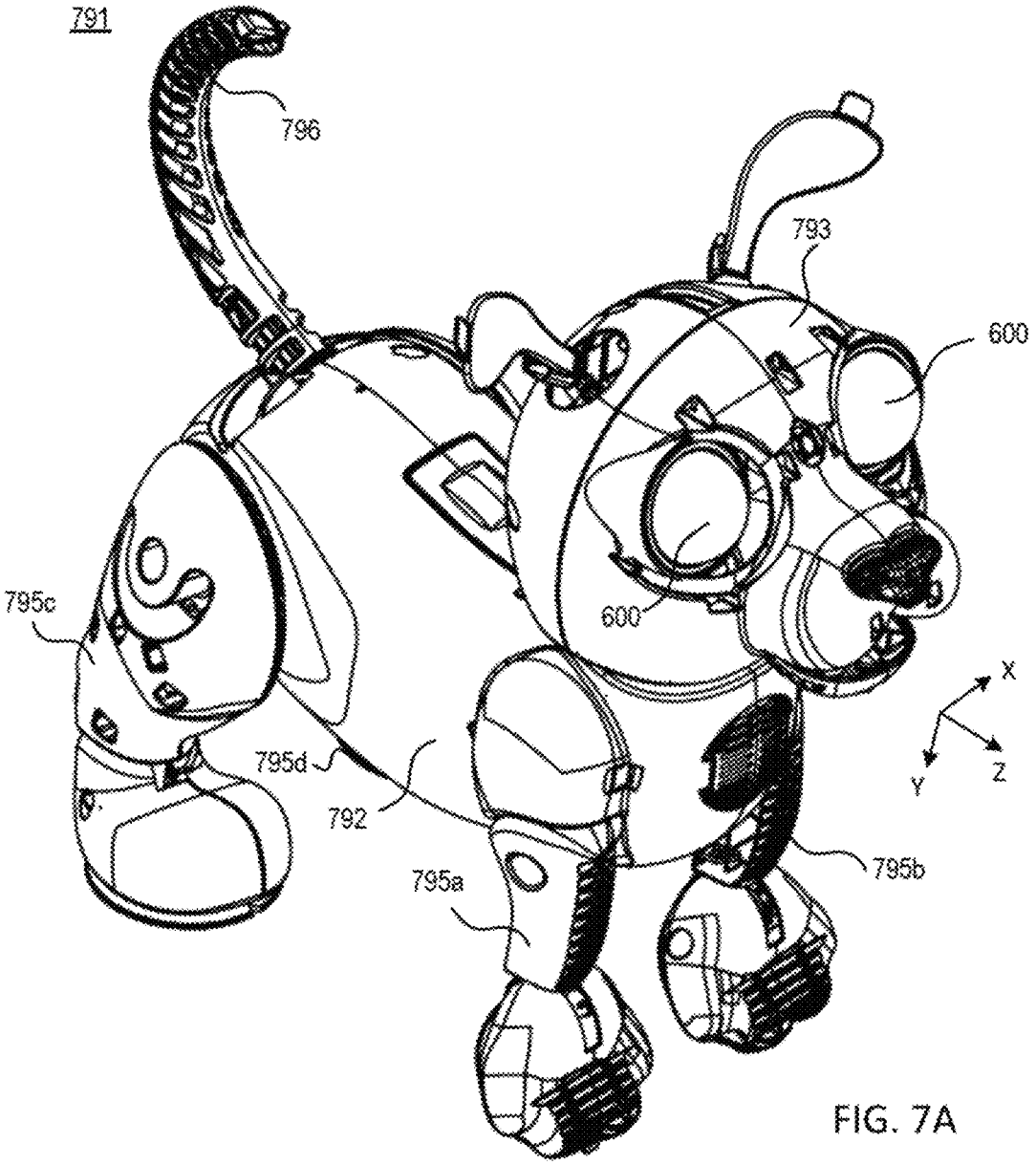

FIG. 7A is a perspective view of a toy figure.

Figure 7B:
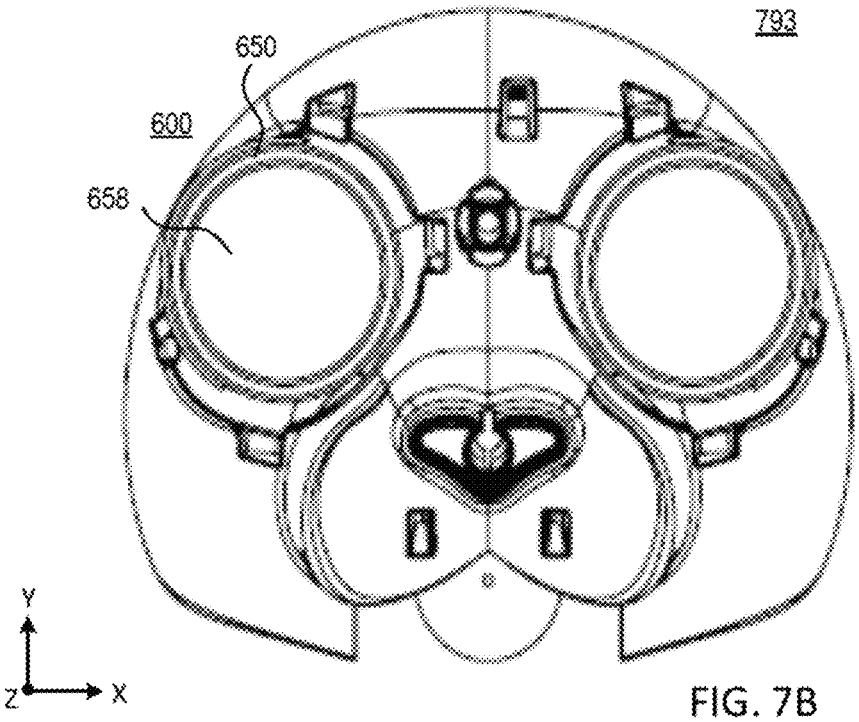

FIG. 7B is a front view of a head of the toy figure of FIG. 7A.

Figure 7C:
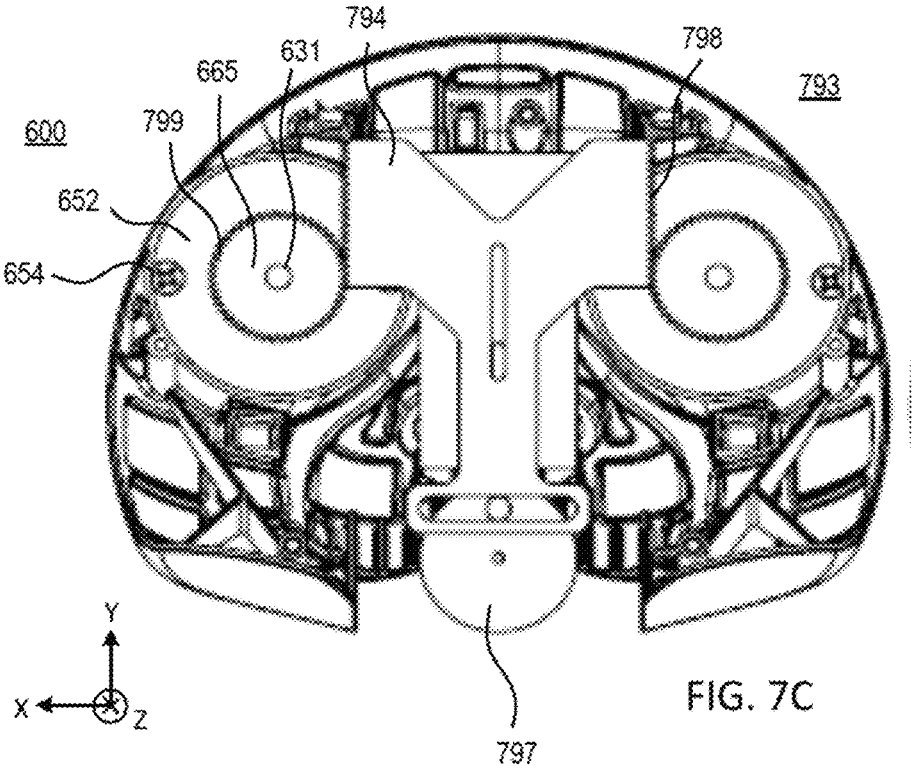
Figure 8A:
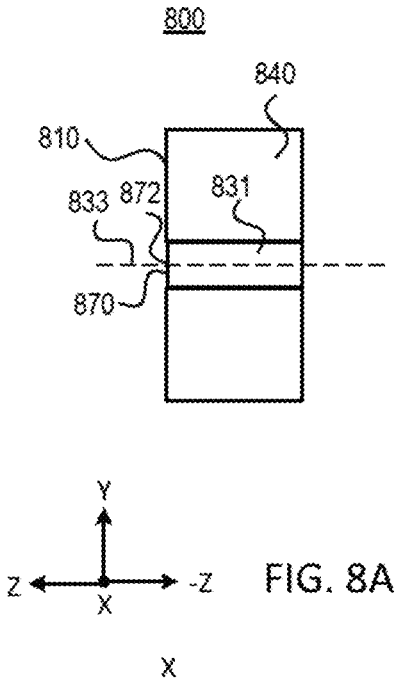
Figure 8B:
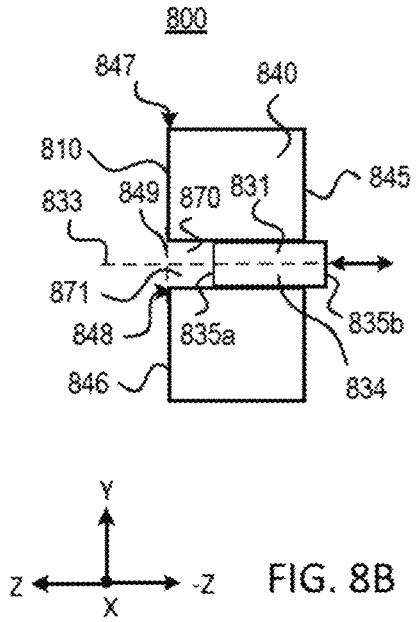

FIG. 7C is a rear cross-sectional view of the head of the toy figure of FIG. 7A FIGS. 8A and 8B are block diagrams of a side cross-sectional view of another apparatus.

Figure 8C:
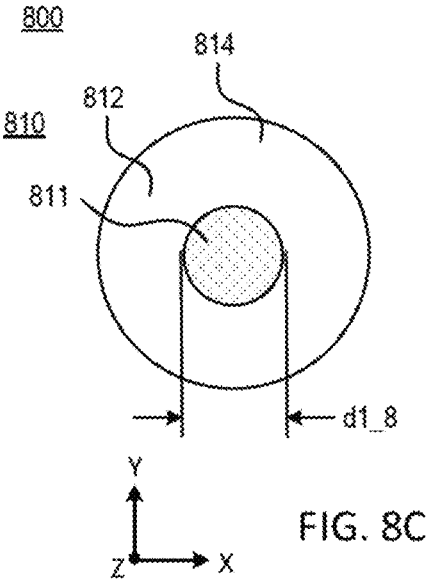
Figure 8D:
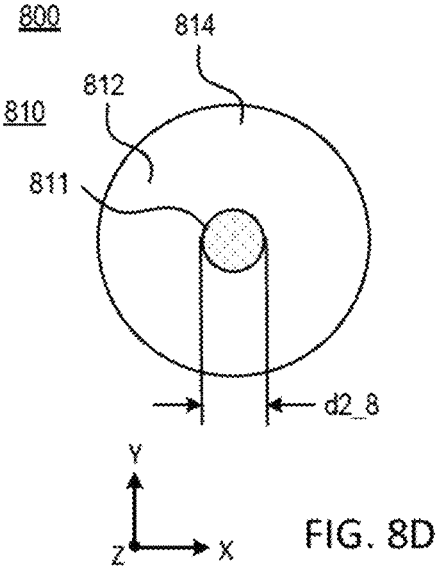

FIGS. 8C and 8D are block diagrams of a front view of the apparatus of FIGS. 8A and 8B.

Figure 8E:
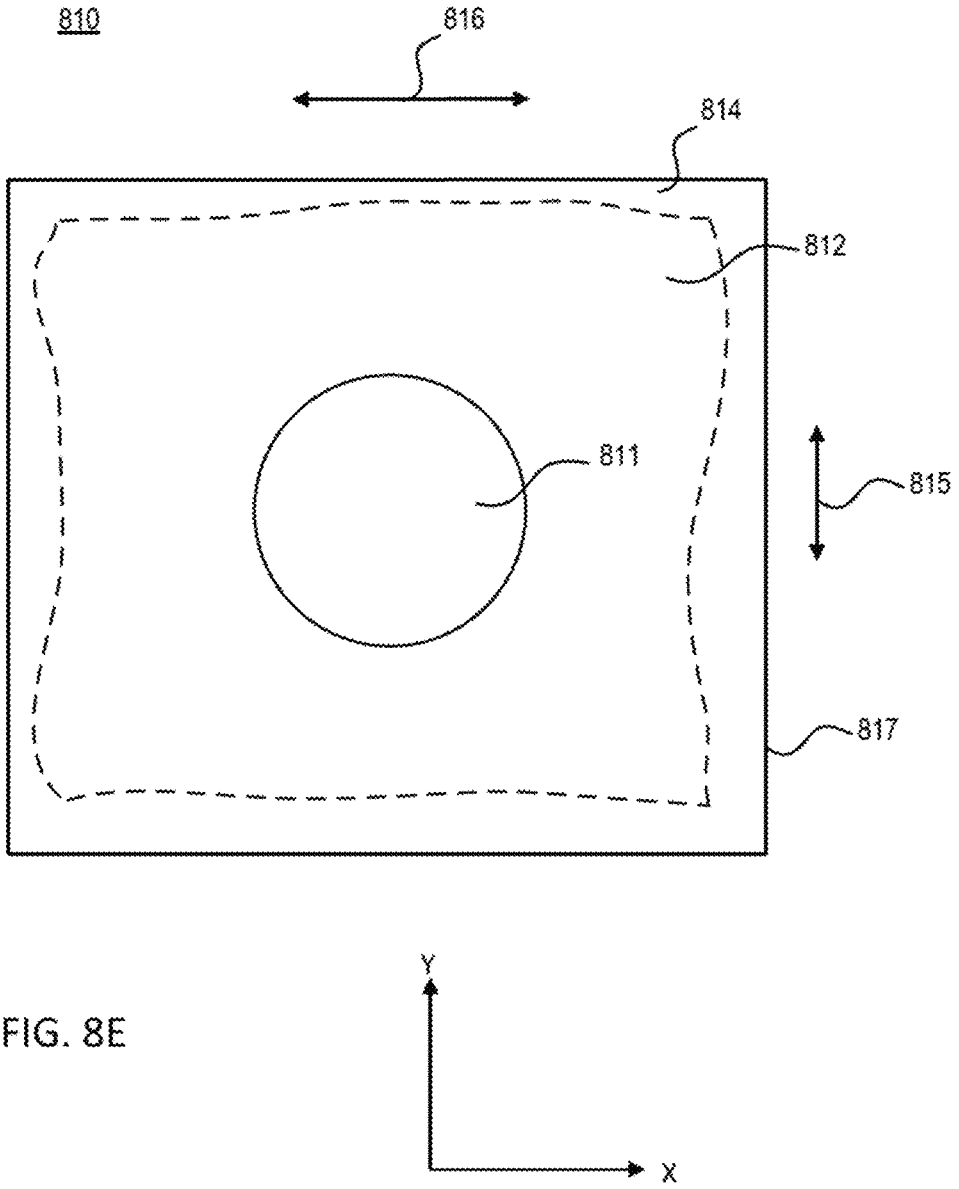

FIG. 8E is a block diagram of a pliable material.

DETAILED DESCRIPTION

Figure 1A:
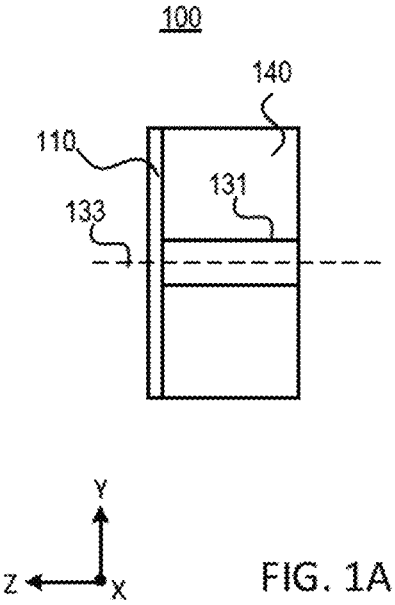
FIG. 1A is a block diagram of a side cross-sectional view of an apparatus
Figure 1B:
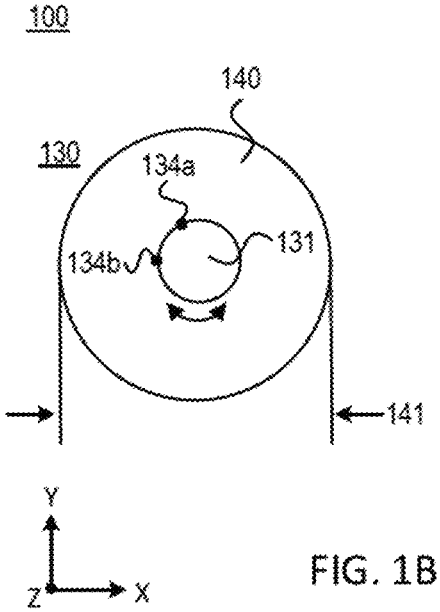
FIG. 1B is a block diagram of a front view of a support structure that may be used with the apparatus of FIG. 1A.
Figure 1C:
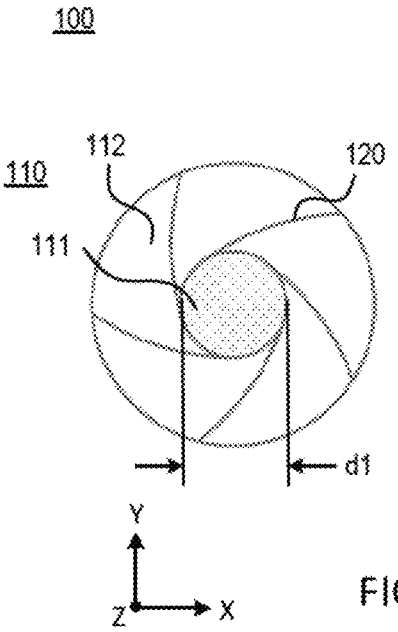
FIGS. 1C and 1D are block diagrams of a front view of the apparatus of FIG. 1A.
Figure 1D:
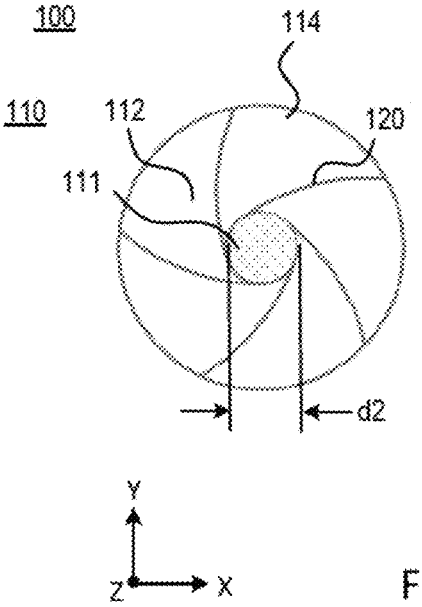

FIG. 1A is a side cross-sectional view of an apparatus 100 in the Y-Z plane. The apparatus 100 may be part of a toy, such as a toy FIG. 791 of FIG. 7, or may be part of a toy system that includes a toy such as the toy FIG. 791. The apparatus 100 includes a foldable material 110 that is connected to a support structure 130. FIG. 1B is a front view of the support structure 130 (without the foldable material 110) in the X-Y plane. FIGS. 1C and 1D are front views of the apparatus 100 and the foldable material 110 in the X-Y plane. The Z direction is out of the page in FIGS. 1C and 1D.

Each of FIGS. 1C and 1D shows the foldable material 110 in a different state. The foldable material 110 changes state by, for example, folding, twisting, or otherwise changing shape in response to manipulation (for example, movement) of the support structure 130. The manipulation may be, for example, a manual movement of the support structure 130 by a user or an automated movement of the support structure 130 by a machine, such as a motor. The foldable material 110 includes a first portion 111 and a second portion 112. As discussed below, the size and/or visibility of the first portion 111 changes in response to manipulation of the support structure 130. Changing the size and/or visibility of the first portion 111 increases the play value and versatility of the apparatus 100. For example, the apparatus 100 may be used as an eye structure in a toy figure or doll. In these implementations, the first portion 111 is the pupil of the eye. The pupil dilates (enlarges) and contracts in response to manipulation of the support structure 130. In another example, the apparatus 100 may be used to provide a reveal feature on a toy figure or doll. For example, the apparatus 100 may be configured to only allow the first portion 111 to be visible (or revealed) in response to a particular user manipulation of the support structure 130.

The support structure 130 includes an inner connection structure 131 and an outer connection structure 140. In the example of FIGS. 1A-1D, the inner connection structure 131 is a cylindrical structure that extends in the X direction along a longitudinal axis 133, and the outer connection structure 140 surrounds the inner connection structure 131. The inner connection structure 131 is configured to rotate about the longitudinal axis 133 relative to the outer connection structure 140. The support structure 130 may include other components that hold the inner connection structure 131 relative to the outer connection structure 140 such as a housing 550 or 650 and a mounting bracket 552 or 652, shown in FIGS. 5D and 6B, respectively.

At least part of the first portion 111 is attached to the inner connection structure 131. For example, all of the first portion 111 may be attached to the inner connection structure 131, or discrete points along the interface between the first portion 111 and the second portion may be attached to the inner connection structure 131. An edge portion 114 of the second portion 112 is attached to the outer connection structure 140. The second portion 112 folds, gathers, and/or twists about the part of the first portion 111 that is attached to the inner connection structure 131 and/or untwists or unfolds when the inner connection structure 131 rotates about the axis 133. In this way, rotating the inner connection structure 131 causes the second portion 112 to fold over some or all of the first portion 111, thereby changing the size of the first portion 111.

FIG. 1C shows a first state in which the foldable material 110 is folded along five (5) folds 120. When viewed in the X-Y plane with the Z direction out of the page, the outer connection structure 140 has a diameter 141, and the first portion 111 has a first diameter d1. The inner connection structure 131 is at a first position 134*a* (FIG. 1B). FIG. 1D shows second state in which the inner connection structure 131 has been rotated counterclockwise from the first position 134*a* to a second position 134*b*. Rotating the inner connection structure 131 from the first position 134*a* to the second position 134*b* deepens the folds 120 and gathers the material in the second portion 112 over an outer region of the first portion 111, thereby reducing the diameter of the first portion 111 to a diameter d2. The edge portion 114 remains attached to the outer connection structure 140 and the diameter 141 of the outer connection structure 140 does not change. Rotating the inner connection structure 131 clockwise from the second position 134*b* to the first position 134*a* reduces the depth of the folds 120 and expands the diameter of the first portion 111 to the diameter d1 (FIG. 1C).

In some implementations, the folds 120 are created by rotating the inner connection structure 131 clockwise from the first position 134*a* to the second position 134*b* or counterclockwise from the second position 134*b* to the first position 134*a*.

Figure 2:
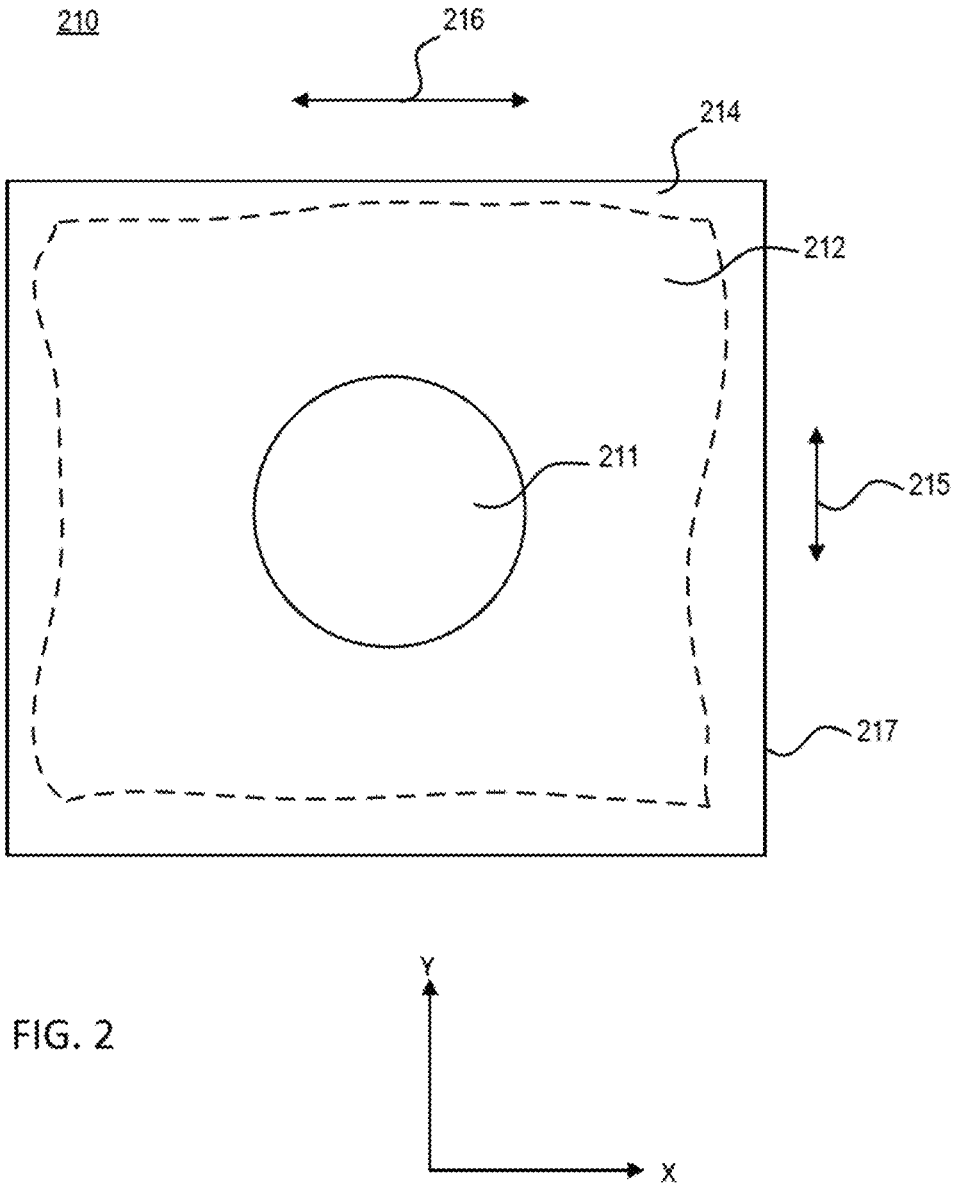
FIGS. 2 and 3 are block diagrams of various foldable materials.

FIG. 2 is a block diagram of a foldable material 210. The foldable material 210 may be attached to the support structure 130, or other support structures (such as a support structure 530 shown in FIGS. 5G-5J). In the example of FIG. 2, the foldable material 210 is not attached to a support structure and is not folded. The foldable material 210 is shown in its equilibrium state in FIG. 2.

The foldable material 210 is a single piece of material that includes a first portion 211 and a second portion 212 that surrounds the first portion 211. The foldable material 210 has a rectangular perimeter 217, but other shapes are possible. For example, the perimeter 217 of the foldable material 210 may be circular or elliptical. The first portion 211 is a circle in the example of FIG. 2. However, the first portion 211 may have other shapes. For example, the first portion 211 may be elliptically shaped. The first portion 211 and the second portion 212 are visually distinct. For example, the first portion 211 may be a first color, and the second portion 212 may be a second color that is different from the first color. In another example, the first portion 211 may include a fanciful design, and the second portion 211 may be a solid color that does not include a design. The second portion 212 includes an edge portion 214, which includes at least part of the perimeter 217. In the example of FIG. 2, the edge portion 214 is between the dotted line and the perimeter 217.

The foldable material 210 may be a woven fabric material or a non-woven material. Examples of a woven fabric material include all types of knit fabrics, for example, rayon, polyester, cotton, and bamboo. The knit fabrics may be blended with spandex. Spandex is a synthetic fiber that expands or contracts when the fiber is manipulated. For example, the spandex may be Lycra produced by E.I. Du Pont De Nemours and Company. Examples of a non-woven material include an elastic material, a polymer film, or a paper material. The foldable material 210 also may be flexible. For example, the foldable material 210 may be a woven fabric material that is flexible, such as a fabric that includes lycra or another stretchable fabric. The foldable fabric 210 may include a first amount of flexibility (or amount of stretch) in a first direction 215, which is along the X direction, and a second amount of flexibility (or amount of stretch) in a second direction 216, which is along the Y direction and is orthogonal to the first direction 215. The amount of flexibility or stretch is any metric or measure that describes the ability of the material 210 to stretch without tearing or ripping. Moreover, the material 210 may be capable of contracting after being stretched. In some implementations, the material 210 returns to its original shape or an equilibrium configuration after being stretched. In implementations in which the foldable material 210 is flexible, the foldable material 210 may have a flexibility ratio, which is the ratio of the first amount of flexibility to the second amount of flexibility, between 1 and 2. A flexibility ratio equal to or near 1 generally results in the most uniform folds.

Figure 3:
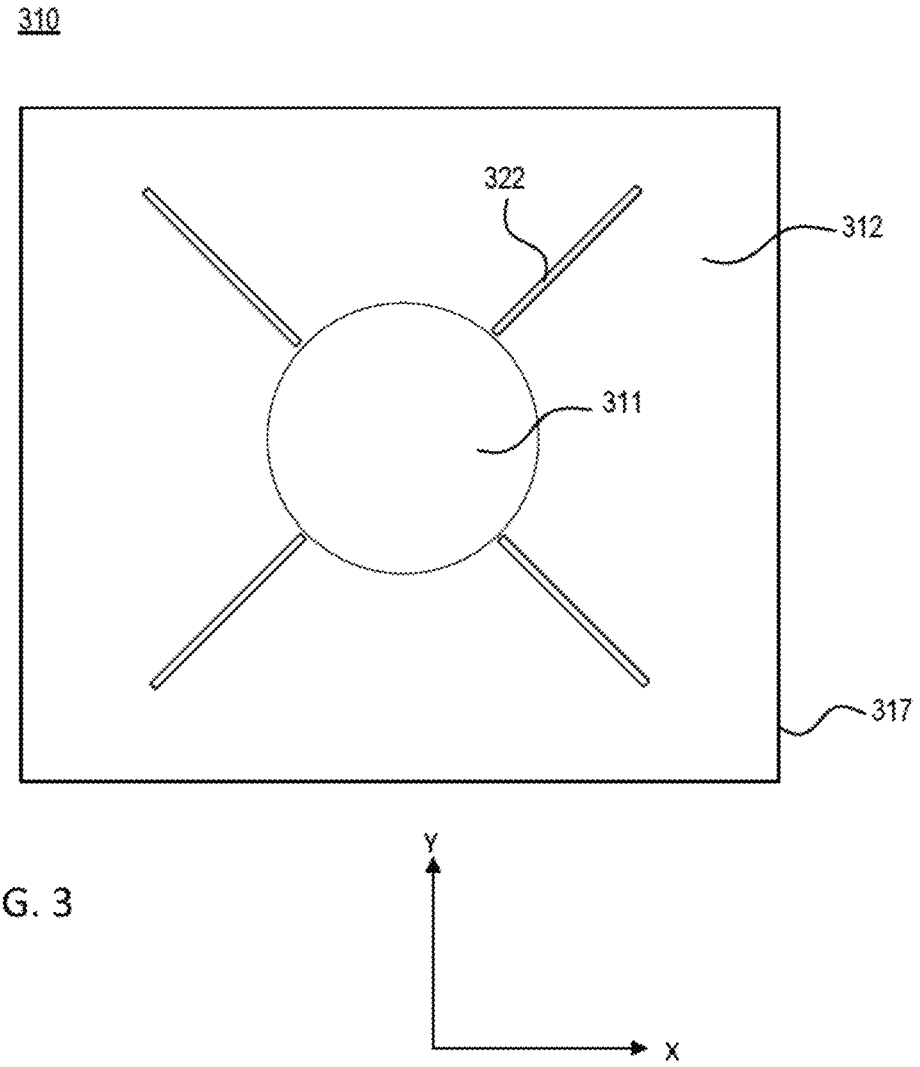

The foldable material 210 may include, for example, one or more pre-formed fold regions. FIG. 3 shows an example of a foldable material 310 that includes four (4) pre-formed fold regions 322. For simplicity, only one of the fold regions 322 is labeled. The pre-formed fold regions 322 are regions that encourage folding. The pre-formed fold regions 322 are formed prior to attaching the foldable material 310 to the support structure 130 (or another support structure). The pre-formed fold regions 322 encourage the foldable material 310 to fold at the pre-formed fold regions 322 as the support structure 130 is manipulated. For example, if the foldable material 310 is a paper material, the foldable material 310 may be scored at each of the pre-formed fold regions 322. In another example, if the foldable material 310 is a woven fabric material, the foldable material 310 may be heat pressed to create wrinkles at each of the pre-formed fold regions 322. Further, for example, if the foldable material 310 is a woven fabric material, the foldable material 310 may also be uniquely woven such that the weaves of the foldable fabric 310 follow a pattern of the preformed fold regions 322.

The foldable material 310 is a single piece of material that includes a first portion 311 and a second portion 312 that surrounds the first portion 311. The foldable material 310 has a rectangular perimeter 317 in the example of FIG. 3. The first portion 311 is a circle in the example of FIG. 3. The first portion 311 and the second portion 312 are visually distinct. In the example of FIG. 3, the pre-formed fold regions 322 are straight lines that extend radially outward from an area near or at an interface between the first portion 311 and the second portion 312 toward the perimeter 317. In the example of FIG. 3, the pre-formed fold regions 322 are in the second portion 312. However, in other implementations, the pre-formed fold regions 322 are formed in the first portion 311 and the second portion 312.

Figure 4B:
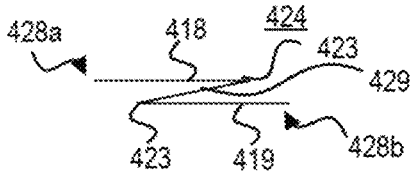
FIG. 4B is a block diagram of a pre-formed fold in the foldable material of FIG. 4A.
Figure 4B:
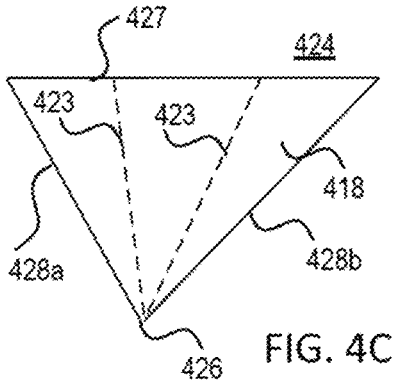
Figure 4C:
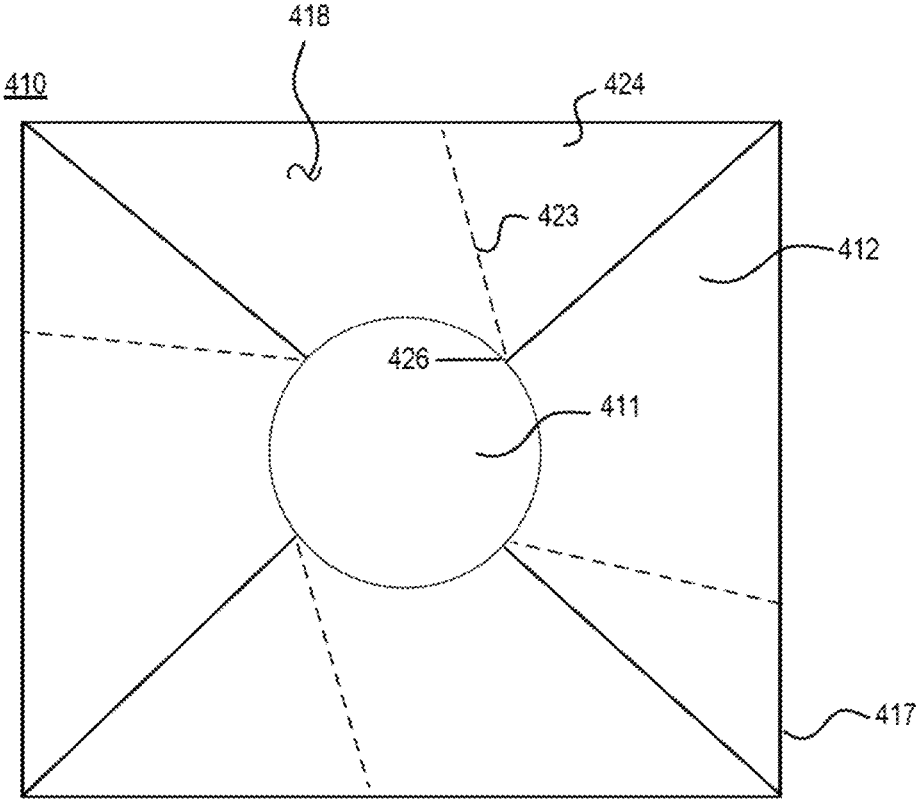
FIG. 4C is a block diagram of a top view of a pre-formed fold in the foldable material of FIG. 4A.
Figure 4A:
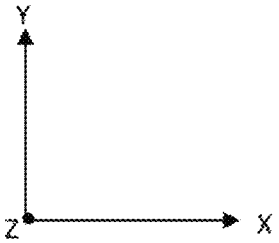
FIG. 4A is a block diagram of another foldable material.

The foldable material 210 may include, for example, one or more pre-formed folds. FIG. 4A is an example of a foldable material 410 that includes four (4) pre-formed folds 424. For simplicity, only one of the folds 424 is labeled. FIG. 4A shows the foldable material 410 in the X-Y plane, with the Z direction coming out of the page. FIG. 4B shows one of the pre-formed folds 424 from the side (for example, in the X-Z plane with the Y direction going into the page).

The foldable material 410 is a single piece of material that includes a first portion 411 and a second portion 412 that surrounds the first portion 411. The foldable material 410 includes a first side 418 and a second side 419 opposite the first side 418.

The pre-formed folds 424 are formed in the foldable material 410 prior to attaching the foldable material 410 to the support structure 130 (or another support structure). The pre-formed folds 424 are formed by bending the material 410 about lines 423. The lines 423 extend radially outward from the first portion 411 toward the perimeter 417. Specifically, to form one of the folds 424, two distinct portions of the first side 418, each on an opposite side of one of the lines 423, are oriented to face each other, and two distinct portions of the second side 419, each on an opposite side of another one of the lines 423, are oriented to face each other, as shown in FIG. 4B. Each fold 424 includes two of the lines 423. The depth of the fold 424 is the length of a segment 429 that includes the material between the two lines 423 of a particular fold 424. FIG. 4C shows a top view of one of the folds 424. Each fold 424 extends radially outward from a tip 426, to a fold edge 427. The fold edge 427 and two sides 428*a* and 428*b*, that each extend from the tip 426 to the fold edge, define the perimeter of the fold 424.

Each of the pre-formed folds 424 may fold or unfold in response to manipulation of the support structure 130. For example, the lengths of the segments 429 of the pre-formed folds 424 may increase or decrease in response to rotation of the inner connection structure 131 (FIG. 1A). The depth of the folds 424 increases when the length of the segment 429 increases. The depth of the folds 424 decreases when the length of the segment 429 decreases.

In the example of FIG. 4, the pre-formed folds 424 are only in the second portion 412. However, in other implementations, the pre-formed folds 424 are formed in the first portion 411 and the second portion 412.

FIG. 5A is a perspective view of an exterior of an apparatus 500. The apparatus 500 is an implementation of the apparatus 100 (FIGS. 1A-1D). FIG. 5B is a front view of the apparatus 500 in the Y-Z plane. FIG. 5C is a side view of the exterior of the apparatus 500. FIG. 5D is a side cross-sectional view of the apparatus 500 taken along the line D-D of FIG. 5C.

The apparatus 500 includes the housing 550, the mounting bracket 552, and a cover 558. The housing 550, the mounting bracket 552, and the cover 558 form the exterior of the apparatus 500. A first side of the housing 550 is attached to the mounting bracket 552. The cover 558 extends from a second side of the housing 550 that is opposite to the first side. The cover 558 is dome-shaped and is made of a transparent material, such as, for example, transparent plastic. The apparatus 500 also includes a motor housing 560. The motor housing 560 is attached to the mounting bracket 552 via mechanical connectors 556. The mechanical connectors 556 may be any type of connection mechanism. For example, the mechanical connectors 556 may be screws.

The housing 550 is attached to the mounting bracket 552 via mechanical connectors 554 (FIG. 5D). The mounting bracket 552 may be used to mount the housing 550 to an external object, such as a portion of a toy figure. The mounting bracket 552 also provides support for components in the housing 550, as discussed below. In the example of FIG. 5A, the mechanical connectors 554 are screws. However, any device or mechanism capable of securing the housing 550 to the mounting bracket 552 may be used as the mechanical connectors 554. For example, the mechanical connectors 554 may be pins, rivets, nails or an adhesive material, such as, for example, epoxy or glue.

Referring also to FIG. 5D and FIG. 5E, the apparatus 500 also includes an outer connection structure 540 and an inner connection structure 531. FIG. 5E shows a front cross-sectional view of the outer connection structure 540 and the inner connection structure 531. The outer connection structure 540 is an annulus that surrounds the end 535. The inner connection structure 531 includes a body 534 and an end 535 that extends from the body 534 in the Z direction. The body 534 and the end 535 are joined together or formed from a single piece of material such that the inner connection structure 531 is a unitary structure. The inner connection structure 531 is received in a cavity 555 of the mounting bracket 552. The inner connection structure 531 is not fixed to the mounting bracket 552 and is able to rotate within the cavity 555.

The motor housing 560 encloses a driving shaft 562. The driving shaft 562 extends along a longitudinal axis 533, which is parallel to the Z direction. The driving shaft 562 is configured to rotate about the axis 533. The body 534 defines a bore 536 at an end that is opposite the end 535. The bore 536 holds a pin 537, which is mechanically connected to the motor shaft 562. The pin 537 mechanically connects the motor shaft 562 to the inner connection structure 531. Thus, the end 535 rotates about the longitudinal axis 533 when the motor shaft 562 rotates about the longitudinal axis 533.

FIG. 5F is a side block diagram of the outer connection structure 540 and the end 535. The outer connection structure 540 includes an edge region 547 and an inner region 548 (also shown in FIG. 5E). The outer connection structure 540 includes a first side 545 and a second side 546. The edge region 547 includes the outer circumference of the second side 546 and includes or is near the portion of the outer connection structure 540 that is connected to the inner wall 551 of the housing 550. The second side 546 is a surface that extends from the edge region 547 to the inner region 548. The second side 546 has a maximum region 543, which is the region of the second side 546 that is farthest from an X-Y plane that includes the first side 545. The second side 546 curves outward (relative to the first side 545) to the maximum region 543 and then curves inward (relative to the first side 545) to the inner region 548. The inner region 548 defines a passage 570 between the second side 546 and the first side 545. The end 535 is positioned in the passage 570, with a recessed region 571 between the end 535 and the tangent 549. In other words, the end 535 is displaced in the −Z direction relative to the maximum region 543 and the tangent 549.

The first side 545 is attached to the mounting bracket 552 at an interface 575 (FIG. 5D). The first side 545 may be attached to the mounting bracket 552 with an adhesive or any other connection mechanism. The outer connection structure 540 is spatially fixed relative to the mounting bracket 552 and the housing 550. As discussed above, the inner connection structure 531 is able to rotate relative to the mounting bracket 552. Thus, the inner connection structure 531 is also able to rotate about the longitudinal axis 533 relative to the outer connection structure 540 and the housing 550.

A foldable material, such as the foldable material 110, 210, 310, or 410 may be attached to the apparatus 500. In the example shown in FIG. 5D, the foldable material 210 is attached to the apparatus 500. The edge portion 214 (FIG. 2) of the flexible material 210 is attached to the outer connection structure 540 at a contact point 544 with a securing apparatus such as, for example, an adhesive. The contact point 544 is on the edge region 547 of the outer connection structure 540. Although only one contact point 544 is labeled in FIGS. 5D and 5E, a plurality of contact points 544 may be used. The contact points 544 may be discrete, or the entire edge region 547 may form a continuous contact region 544 such that all or almost all of the edge portion 214 of the flexible material 210 is secured to the edge region 547 of the outer connection structure 540.

The outer connection structure 540 also includes a channel 542 that encircles the outer connection structure in the X-Y plane. The channel 542 is sized to hold an elastic band or a non-elastic or elastic string. In some implementations, the edge portion 214 is placed over the channel 542 and an elastic band or a string is placed over the edge portion 214 in the channel 542. The band or string is tightened, thereby securing the edge portion 214 to the outer connection structure 540. The edge portion 214 may be secured at the channel 542 instead of or in addition to being secured at the contact point 544. Moreover, the edge portion 214 may be secured to the outer connection structure 540 only at the contact point or points 544 and without being secured at the channel 542.

At least part of the first portion 211 is attached to a contact point 572 at the end 535 by a securing apparatus such as, for example, an adhesive. Although only one contact point 572 is illustrated in FIGS. 5D and 5E, the first portion 211 may be attached to the end 535 at more than one contact point 572. In some implementations, the number of folds that appear in the foldable material 210 may be controlled or determined. For example, in a foldable material that does not include pre-formed folds or pre-formed fold regions (such as the foldable material 210), the number of contact points 572 may determine the number of folds that appear when the inner connection structure 531 is rotated relative to the outer connection structure 540. In these implementations, the number of folds may be the same as the number of contact points 572. In another example, a difference between the radius of the end 535 of the inner connection structure 53 land the radius of the edge region 547 may determine the number of folds that appear when the inner connection structure 531 is rotated.

In implementations that use a foldable material that includes pre-formed fold regions (such as the foldable material 310 of FIG. 3), each fold region may be attached to a discrete contact point 572. Similarly, in implementations that use a foldable material that includes pre-formed folds (such as the foldable material 410 of FIG. 4), the tip 426 of each pre-formed fold 424 is attached to a contact point 572.

FIG. 5G is a front view of the support structure 530 in the X-Y plane with the Z direction out of the page. The support structure 530 includes the inner connection structure 531 and the outer connection structure 540. The foldable fabric is not shown in FIG. 5G. The inner connection structure 531 rotates relative to the outer connection structure 540 and may rotate clockwise or counterclockwise. The inner connection structure 531 has a range of motion and is only able to rotate within the range of motion. The range of motion of the inner connection structure 531 may be, for example, 360 degrees (°), less than 360°, or greater than 360°. The range of motion of the inner connection structure 531 is the angular distance through which any point on the circumference of the inner connection structure 531 is able to rotate relative to the outer connection structure 540. The range of motion is illustrated in FIG. 5G by a first position 534*a* and a second position 534*c*. A reference point 577 on a circumference of the end 535 is able to rotate in the counterclockwise direction from the first position 534*a* to the second position 534*c* and in the clockwise direction from the second position 534*c* to the first position 534*a*.

Each of FIGS. 5H-5J is a front view of the support structure 530 with the foldable fabric 210. The FIGS. 5H-5J show the foldable fabric 210, respectively, when the reference point 577 is at the first position 534*a*, a third position 534*b* between the first position 534*a* and the second position 534*c*, and the second position 534*c*. In other words, FIGS. 5H-5J shows the changes in the foldable fabric 210 as the inner connection structure 531 rotates through its range of motion.

FIG. 5H shows the foldable material 210 when the inner connection structure 531 is at a first end of its range of motion (the reference point 577 is at the first position 534*a*). In the implementation of FIG. 5H, the foldable material 210 is in the equilibrium state and no folds are present. The inner portion 211 has a diameter d1_5, which is the same as the diameter of the inner portion 211 when the foldable material 210 is in the equilibrium state.

FIG. 5I shows a second state after the inner connection structure 531 has been rotated counterclockwise (the reference point 577 has been rotated from the first position 534*a* to the third position 534*b*). Rotating the inner connection structure 531 such that the reference point 577 moves from the first position 534*a* to the second position 534*b* draws some of the material of the first portion 211 into the recessed region 571 (FIG. 5F) and gathers the material to create folds 520, thereby reducing the diameter of the first portion 211 to a second diameter d2_5. The second diameter d2_5 is smaller than the first diameter d1_5.

FIG. 5J shows a third state after the inner connection structure 531 has been rotated counterclockwise from the third position 534*b* to the second position 534*c* (the reference point 577 has been rotated from the third position 534*b* to the second position 534*c*). In other words, as compared to FIG. 5H, FIG. 5J shows the support structure 530 when the inner connection structure 531 is at a second end of its range of motion. In the implementation shown in FIGS. 5G-5J, rotating the inner connection structure 531 from the third position 534*b* to the second position 534*c* gathers the remaining material in the first portion 211 into the recessed region 571 (FIGS. 5D and 5F) and deepens the folds 520 such that the first portion 211 is not visible when the support structure 530 is viewed from the front.

Rotating the inner connection structure 531 clockwise from the second position 534*c* back to the first position 534*a* expands the diameter of the first portion 211. Rotating the inner connection structure 531 clockwise such that the reference point 577 moves from the second position 534*c* to the third position 534*b* reduces the depths of the folds 520, pushes some of the material of the inner portion 211 out of the recessed region 571, and expands the diameter of the first portion 511 to the second diameter d2_5. Rotating the inner connection structure 531 clockwise such that the reference point 577 moves from the third position 534*c* to the first position 534*a* further reduces the depths of the folds 520, pushes additional material of the inner portion 211 out of the recessed region 571, and expands the diameter of the first portion 511 to the first diameter d1_5.

The range of motion discussed with respect to FIG. 5G-5J is an example, and other implementations are possible. For example, the range of motion may be double the range of motion discussed in the above example. In these implementations, the inner connection structure 531 may be rotated clockwise or counterclockwise when the reference point 577 is at the first position 534*a* such that the diameter of the inner portion 211 may be reduced to zero or made invisible by rotating the inner connection structure 531 in either of two possible directions.

FIG. 6A is a side view of the exterior of an apparatus 600. The apparatus 600 is an implementation of the apparatus 100 (FIGS. 1A-1D). FIG. 6B is a side cross-sectional view of the apparatus 600 taken along the line B-B of FIG. 6A.

The apparatus 600 includes the housing 650, the mounting bracket 652, and a cover 658. The housing 650, the mounting bracket 652, and the cover 658 form the exterior of the apparatus 600. The mounting bracket 652 may be used to mount the housing 650 to an external object, such as a portion of a toy figure. The mounting bracket also provides support for the components in the housing 650.

A first side of the housing 650 is attached to the mounting bracket 652. The cover 658 extends from a second side of the housing 650 that is opposite to the first side. The cover 658 is dome-shaped and is made of a transparent material. The housing 650 is attached to the mounting bracket 652 via mechanical connectors 654. The mechanical connectors 654 may be any device or mechanism capable of securing the housing 650 to the mounting bracket 652. For example, the mechanical connectors 654 may be screws.

The apparatus 600 also includes a gear 665. The gear 665 is configured to rotate about a longitudinal axis 633 (FIG. 6B) that is parallel to the Z direction. The gear 665 is configured to be driven by a gear system 667. The gear system 667 includes one or more gears and/or elements that are configured to interact with the gear 665 such that the gear 665 rotates. The gear 665 is attached to an inner connection structure 631. The gear 665 may be attached to the inner connection structure 631 by any type of attachment mechanism. For example, the inner connection structure 631 may be attached to the gear 665 with pins, rivets, nails, screws, or an adhesive material, such as, for example, epoxy or glue.

FIG. 6D shows a perspective view of the inner connection structure 631. The inner connection structure 631 includes a body 634, a rod portion 638 that extends from the body 634 in the −Z direction, and an end 635 that extends from the body 634 in the +Z direction. The body 634, the rod portion 638, and the end 635 are joined together or formed from a single piece of material such that the inner connection structure 631 is a unitary structure. The body 634 is received in a cavity 655 (FIG. 6B) of the mounting bracket 652. The rod 638 extends in the −Z direction through an opening in the cavity 655 to the exterior of the apparatus 500. The inner connection structure 631 is not fixed to the mounting bracket 652 and the body 634 is able to rotate within the cavity 655.

Referring to FIGS. 6B and 6C, the apparatus 600 also includes an outer connection structure 640. FIG. 6C is a block diagram of an inset 690 labeled in FIG. 6B. The inset 690 shows a portion of the outer connection structure 640 and the end 635. The outer connection structure 640 includes a first side 645 and a second side 646. The outer connection structure 640 includes an edge region 647 and an inner region 648. The edge portion 647 of the outer connection structure 640 is connected to an inner wall 651 of the housing 650 with, for example, an adhesive such as glue, solvent welding, sonic welding, or thermal bonding. Attaching the outer connection structure at interface 675 and to the inner wall 651 results in the outer connection structure 640 being spatially fixed relative to the mounting bracket 652 and the housing 650. The inner connection structure 631 is able to rotate with the gear 665 about the longitudinal axis 633 relative to the outer connection structure 640 and the housing 650. Thus, the inner connection structure 631 also rotates relative to the outer connection structure 640 and the housing 650.

The edge region 647 includes the outer circumference of the second side 646. The second side 646 is a surface that extends from the edge region 647 to the inner region 648. The second side 646 curves outward (relative to the first side 645) to a maximum region 643 that is farthest from an X-Y plane that includes the first side 645. The second side 646 then curves inward (relative to the first side 645) to the inner region 648. The inner region 648 defines a passage 670 between the second side 646 and the first side 645. The end 635 is positioned in the passage 670, with a recessed region between the end 635 and a tangent 649. In other words, the end 635 is displaced in the −Z direction relative to the maximum region 643 of the second side 646 and the tangent 649.

A foldable material, such as the foldable material 110, 210, 310, or 410 is attached to the apparatus 600. In the example shown in FIGS. 6B and 6C, the foldable material 210 is attached to the apparatus 600. The edge portion 214 (FIG. 2) of the foldable material 210 is attached to the outer connection structure 640 at a contact point 644 with a securing apparatus such as, for example, an adhesive. The contact point 644 is on the edge region 647 of the outer connection structure 640. Although only one contact point is labeled in FIG. 6B, a plurality of contact points 644 may be used. The contact points 644 may be discrete, or the entire edge region 647 may form a continuous contact region 644 such that all or almost all of the edge portion 214 of the flexible material 210 is secured to the edge region 647 of the outer connection structure 640. The outer connection structure 640 also includes a channel 642 that encircles the outer connection structure 640 in the X-Y plane. The channel 642 is sized to hold a rigid or semi-rigid mechanical fastener such as, for example, an elastic band, a string, a snap-fit ring, or a ratcheting cable tie. The mechanical fastener is tightened, thereby securing the edge portion 214 to the outer connection structure 540.

Referring to FIGS. 6B, 6C, 6E, and 6F, the apparatus 600 includes a peg 632. FIG. 6E shows a side view of the exterior of the peg 632. FIG. 6F shows a top view of the exterior of the end 635 of the inner connection structure 631. The peg 632 is used to attach the foldable fabric 210 to the inner connection structure 631, as discussed below.

The peg 632 includes an end 639*a* and a body 639*b* that extends for an extent 678 from the end 639*a* in the −Z direction to a tip 676. The end 639*a* and the body 639*b* are joined together or formed from a single piece of material such that the peg 632 is a unitary structure. The body 639*b* is received in the end 635 of the inner connection structure 631 (FIG. 6C). The body 639*b* of the peg 632 is a protrusion that fits into a recess 679 at the end 635. The recess 679 has a cross-section in the X-Y plane that has approximately the same shape and size as the cross-section of the body 639*b* in the X-Y plane. The recess 679 is slightly larger than the body 639*b* such that the recess 679 is able to hold the body 639*b* securely with, for example, a friction fit or a barbed adaptor. The barbed adaptor may be a Christmas tree shape. The body 639*b* is a cone-like structure that has a plus-shaped or cross-shaped cross-section in the X-Y plane, as shown in FIG. 6F. The cross-section is a shape defined by four (4) lobes, each lobe extending from a central region 681. The recess 679 is at the end 635 and also has a plus-shaped cross-section in the X-Y plane. The recess 679 has a depth in the Z-direction that is approximately equal to the extent 678. Therefore, when the body 639*b* is received in the recess 679, the end 639*a* is adjacent to with the end 635 of the inner connection structure 631.

Referring to FIG. 6C, the foldable material 210 is placed on the second side 646 of the outer connection structure 640 and is held to the end 635 with the peg 632. At least part of the first portion 211 (FIG. 2) of the foldable material 210 is captured between the tip 676 and the recess 679. By capturing at least some of the first portion 211 with the tip 676, the foldable fabric 210 is also captured between the body 639*b* of the peg 632 and a wall 674 that defines the recess 679. This secures the foldable material 210 to the inner connection structure 631. The peg 632 is not able to rotate in the recess 679 due to the shape of the body 639*b*. This configuration prevents the foldable fabric 210 from spinning relative to the inner connection mechanism 631.

The cross-sectional shape of the body 639*b* and the recess 679 may be any cross-sectional shape that prevents relative rotation of the body 639*b* and the end 635 when the body 639*b* is received in the recess 679. For example, the body 639*b* and the recess 679 may each have a cross-section in the X-Y plane that contains three lobes extending from the central region 681, five lobes extending from the central region 681, or six lobes extending from the central region 681. In another example, the body 639*b* may contain a plurality of cone-like structures each extending from the end 639*a* in the −Z direction to the tip 676 with the extent 678. In this example, the end 635 contains a plurality of recesses 679 with a depth in the Z-direction that is approximately equal to the extent 678, each recess 679 having a cross-section in the X-Y plane that is approximately the same shape and size as the cross-section of each of the cone-like structures of the body 639*b*.

In some implementations, the foldable material 210 is directly secured to the end 635 of the inner connection structure 631 and the body 639*b* of the peg 632 with an adhesive material, such as, for example, epoxy or glue.

FIG. 7A shows a perspective view of the toy FIG. 791 that includes two instances of the apparatus 600. The toy FIG. 791 includes a body 792 and a head 793. Each of the two instances of the apparatus 600 is used as an eye structure in the head 793 of the toy FIG. 791. The first portion 211 of the foldable fabric 210 is the pupil of the eye, and the second portion 212 is the iris of the eye. The pupil dilates (enlarges) and contracts in response to manipulation of the inner connection structure 631. The head 793 has two ears and the body has five appendages: four legs 795*a*, 795*b*, 795*c*, 795*d* and a tail 796. The toy FIG. 791 is shown as a toy tiger. However, the toy FIG. 791 may be any toy figure that includes one or more eye structures, the apparatus 600 used as each of the eye structures. For example, the toy FIG. 791 may be a doll or an animal such as, for example, a cat, a dog, or a lion.

FIG. 7B shows a front view of the head 793 in the X-Y plane with the Z direction out of the page. FIG. 7C shows a rear cross-sectional view of the head 793 in the X-Y plane with the Z direction into the page. The inner connection structure 631 is attached to the gear 665. When the gear 665 is rotated, the inner connection structure 631 also rotates and changes the size of the first portion 211. For example, the first portion 211 dilates or contracts when the inner connection structure 631 is rotated. The gear 665 is rotated by translation of a driving structure 794 in the Y direction. The driving structure 794 is configured to move linearly in the +Y direction and the −Y direction. The driving structure 794 includes teeth-like ridged edges 798 that fit into corresponding ridged edges 799 of the gear 665 such that the ridged edges of gear 665 catch within the ridged edges of the driving structure 794. In this way, linear movement of the driving structure 794 in the Y direction causes rotational movement of the gear 665 about the axis 633 (FIG. 6B).

The driving structure 794 is mechanically connected to a rotating disk 797. The rotating disk 794, the driving structure 794, and the gear 665 form a gear system. The rotating disk 797 rotates about an axis in the Z direction. The driving structure 794 is mechanically connected to the rotating disk 797 such that the rotation of the rotating disk 797 causes linear movement of the driving structure 794 in the Y direction. The rotating disk 797 may be mechanically connected to an activation feature accessible from an exterior of the FIG. 791. Movement or manipulation of the activation feature rotates the rotating disk 797.

The activation feature may be, for example, one or more of the legs 795*a*, 795*b*, 795*c*, 795*d* and the tail 796. For example, the tail 796 may move back and forth in the X-Y plane to replicate a motion of the toy FIG. 791 wagging the tail 796. In this example, the movement of the tail 796 in the X-Y plane causes the rotating disk 797 to rotate. In another example, the activation feature is a mechanical interface such as, for example, a button or a slider positioned on the toy FIG. 791.

FIGS. 8A and 8B are side cross-sectional views of an apparatus 800 in the Y-Z plane. FIG. 8A shows the apparatus 800 in a first state. FIG. 8B shows the apparatus 800 in a second state. FIG. 1C is a front view of the apparatus 800 in the X-Y plane when the apparatus 800 is in the first state.

FIG. 1D is a front view of the apparatus 800 in the X-Y plane when the apparatus 800 is in the second state. The apparatus 800 may be a part of a toy, such as the toy FIG. 791 of FIG. 7, or may be part of a toy system that includes a toy, such as the toy FIG. 791.

The apparatus 800 includes a pliable material 810 that is connected to an outer connection structure 840 and to an inner connection structure 831. The inner connection structure 831 includes a body 834, a first end 835*a*, and a second end 835*b*. The body 834 of the inner connection structure 831 is a cylindrical structure that extends in the −Z direction along a longitudinal axis 833 from the first end 835*a* to the second end 835*b*. The first end 835*a* and the second end 835*b* are surfaces on opposite sides of an exterior of the body 834

The outer connection structure 840 surrounds the inner connection structure 831. The outer connection structure 840 includes a first side 845 and a second side 846 opposite the first side 845. The first side 845 and the second side 846 extend in the X-Y plane from an edge region 847 to an inner region 848. The inner region 848 surrounds the inner connection structure 831. The inner region 848 defines a passage 870 that extends along the Z direction between the first side 845 and the second side 846.

The inner connection structure 831 is positioned in the passage 870. The inner connection structure 831 is not fixed to the outer connection structure 840. The inner connection structure 831 is configured to translate relative to the outer connection structure 840 along the longitudinal axis 833. In other words, the inner connection structure 831 is configured to move in the Z and −Z directions in the passage 870 relative to the outer connection structure 840.

The apparatus 800 may include other components that hold the inner connection structure 831 relative to the outer connection structure 840 such as a housing (similar to the housing 550 or 650) and/or a mounting bracket (similar to the mounting bracket 552 or 652, shown in FIGS. 5D and 6B, respectively). The end 835*b* of the inner connection structure 831 may be coupled to a mechanism (not shown) that allows the user to control the translation of the inner connection structure 831. For example, the end 835*b* may be coupled to a motor, a linear gear system, a pushing structure, a linear actuator, or a translation stage. In some implementations, the user causes the inner connection structure 831 to move in the −Z and Z directions by direct manual manipulation of the end 835*b*.

Referring also to FIG. 8E, a block diagram of the pliable material 810 when it is not attached to the inner connection structure 831 and the outer connection structure 840 is shown. The pliable material 810 is supple enough to bend and unbend repeatedly without any breakage of the pliable material 810 occurring. For example, the pliable material 810 may bend, fold, twist, or otherwise be manipulated without breaking. The pliable material 810 may be a woven fabric or non-woven material. The pliable material 810 may be a flexible material. For example, the pliable material 810 may be a woven fabric material that is flexible, such as, for example, lycra or another stretchable fabric. The pliable material 810 may be a non-woven material that is flexible such as, for example, an elastic material, a polymer film, or a paper material. The pliable material 810 may be a foldable material.

The pliable material 810 is a single piece of material that includes a first portion 811 and a second portion 812 that surrounds the first portion 811. The foldable material 810 has a rectangular perimeter 817, but other shapes are possible. For example, the perimeter 817 of the pliable material 810 may be circular or elliptical. The first portion 811 is a circle in the example of FIG. 8E. However, the first portion 811 may have other shapes. For example, the first portion 811 may be elliptically shaped. The first portion 811 may be a first color, and the second portion 812 may be a second color that is different from the first color. In another example, the first portion 811 may include a fanciful design, and the second portion 812 may be a solid color that does not include a design. The second portion 812 includes an edge portion 814, which includes at least part of the perimeter 817. In the example of FIG. 8E, the edge portion 814 is between the dotted line and the perimeter 817.

Referring also to FIGS. 8A and 8B, at least part of the first portion 811 is attached or secured to an end 835*a* of the inner connection structure 831 at a connection point 872 using, for example, an adhesive. The part of the first portion 811 that is attached at the connection point 872 may be all of the first portion 811 or less than all of the first portion 811. In some implementations, more than one part of the first portion 811 is attached to the end 835*a* at a plurality of discrete points. The edge portion 814 of the second portion 812 is attached to the outer connection structure 840 with, for example, an adhesive or a band. Some parts of the pliable material 810 are not attached or secured to the outer connection structure 840 or the inner connection structure 831.

Referring also to FIGS. 8C and 8D, the pliable material 810 changes shape when the inner connection structure 831 moves along the axis 833 relative to the outer connection structure 840. In the first state (FIGS. 8A and 8C), the end 835*a* is substantially flush with the first side 546 of the outer connection structure 840. The inner portion 811 has a diameter of d1_8.

To change to the second state (FIGS. 8B and 8D), the inner connection structure 831 is translated in the −Z direction along the longitudinal axis 833. Because the pliable material 810 is attached to the end 835*a*, some of the pliable material 810 is pulled into the recessed region 871 when the inner connection structure moves in the −Z direction. This changes the shape of the pliable material 810. For example, in implementations in which the pliable material 810 is a flexible material, when the inner connection structure 840 translates in the −Z direction, the second portion 812 stretches and the first portion 811 recedes into the recess 871 and into the passage 870. As a result, the diameter of the first portion 811 decreases from d1_8 to d2_8 and the visible area of the second portion 812 increases. After the second connection portion 831 translates in the −Z direction, the area of the second portion 812 has increased and the diameter of the visible part of the first portion 811 has decreased from d1_8 to d2_8 (FIG. 8D). Translating the inner connection structure 831 in the Z direction pushes the pliable material 810 out of passage 870, thereby expanding the visible diameter (of the first portion 811 to the diameter d1_8 (FIG. 8C).

The apparatus 800 may be used as post of a toy figure. For example, two instances of the apparatus 800 may be used as the eyes of the toy FIG. 791. In these implementations, the inner connection structure 831 may be coupled to, for example, one or more of the four legs 795*a*, 795*b*, 795*c*, 795*d* or the tail 796 such that the pliable material 810 of both instances of the apparatus 800 changes shape in response to user manipulation of any of the four legs 795*a*, 795*b*, 795*c*, 795*d* or the tail 796.

Other implementations are within the scope of the claims.

What is claimed is:

1. An apparatus comprising:

a foldable material comprising a first portion and a second portion, the second portion at least partially surrounding the first portion;

an inner connection structure; and an outer connection structure, wherein the inner connection structure is configured to rotate relative to the outer connection structure; at least part of the first portion of the foldable material is attached to the inner connection structure and at least part of the second portion of the foldable material is attached to the outer connection structure; the foldable material changes shape when the inner connection structure rotates relative to the outer connection structure; and the apparatus is a replica eye for a toy, the first portion is a pupil portion, and the second portion is an iris portion.

2. The apparatus of claim 1, wherein a central region of the first portion is attached to the inner connection structure, and an outer edge of the second portion is attached to the outer connection structure.

3. The apparatus of claim 1, wherein the inner connection structure has a rotational range of motion from a first position to a second position, the inner connection structure is configured to rotate from the second position to the first position in a first direction, and the inner connection structure is configured to rotate from the first position to the second position in a second direction.

4. The apparatus of claim 3, wherein the first portion of the foldable material is attached to an end of the inner connection structure, and the inner connection structure is recessed relative to the outer connection structure such that a recessed region exists at the end of the inner connection structure, and the first portion is drawn into the recessed region when the inner connection structure is rotated in the first direction.

5. The apparatus of claim 3, wherein the foldable material changes shape by folding.

6. The apparatus of claim 5, wherein the foldable material folds to form one or more folds only when the inner connection structure is not at the second position, and the foldable material does not comprise any folds when the inner connection structure is at the second position.

7. The apparatus of claim 5, wherein the foldable material comprises one or more pre-formed fold regions, and the foldable material folds along the one or more pre-formed fold regions.

8. The apparatus of claim 5, wherein one or more folds are pre-formed in the foldable material prior to attaching the foldable material to the inner connection structure, and additional folding or unfolding occurs when the inner connection structure rotates relative.

9. The apparatus of claim 1, wherein the inner connection structure comprises a rod mechanically coupled to a driving mechanism;

the outer connection structure comprises a sidewall that extends along a longitudinal axis, and a curved surface at one end of the sidewall;

the curved surface defines a central region, and the curved surface has a tangent that is perpendicular to the sidewall;

the rod extends into the central region of the curved surface and is recessed from the tangent;

the foldable material contacts the curved surface;

the outer portion of the foldable material is attached to the sidewall; and the inner portion of the foldable material is attached to the rod.

10. The apparatus of claim 1, wherein the foldable material comprises a flexible material.

11. The apparatus of claim 1, wherein the second portion changes shape when the inner connection structure rotates relative to the outer connection structure.

12. An apparatus for a toy, the apparatus comprising:

a pliable material;

an outer connection structure; and an inner connection structure configured to move relative to the outer connection structure, wherein an outer region of the pliable material is attached to the outer connection structure, an inner region of the pliable material is attached to the inner connection structure, the pliable material changes shape when the inner connection structure moves relative to the outer connection structure, the inner connection structure is configured to translate relative to the outer connection structure in a first direction and a second direction that is opposite the first direction, and the first and second directions are perpendicular to a surface tangent of the outer connection structure, and the pliable material is pulled into a recessed region at an end of the inner connection structure when the inner connection structure moves in the second direction to thereby change the shape of the pliable material.

13. The apparatus of claim 12, wherein the pliable material comprises a foldable fabric, and the inner connection structure is configured to rotate relative to the outer connection structure.

14. The apparatus of claim 13, wherein the foldable fabric changes shape by folding or unfolding when the inner connection structure rotates.

15. The apparatus of claim 12, wherein the apparatus is a replica eye for a toy, and the pliable material comprises a first portion that is a pupil portion and a second portion that is an iris portion.

16. The apparatus of claim 12, wherein the apparatus is a reveal feature on a toy, and the first portion comprises a fanciful design configured to be revealed by moving the inner connection structure relative to the outer connection structure.

17. A toy comprising:

a body;

an activation feature on the body; and one or more apparatuses, each apparatus comprising:

a foldable material comprising a first portion and a second portion, the second portion at least partially surrounding the first portion;

an inner connection structure coupled to the activation feature; and an outer connection structure, wherein the inner connection structure is configured to rotate relative to the outer connection structure in response to movement of the activation feature; at least part of the first portion of the foldable material is attached to the inner connection structure and at least part of the second portion of the foldable material is attached to the outer connection structure; the foldable material changes shape when the inner connection structure rotates relative to the outer connection structure; and each of the one or more apparatuses is a replica eye for the toy, wherein the first portion is a pupil portion and the second portion is an iris portion.

18. The toy of claim 17, wherein the toy comprises a doll comprising a face portion and two of the one or more apparatuses.

19. The toy of claim 18, wherein the first portions of the foldable material of the first and second apparatuses change shape by expanding or contracting in unison in response to movement of the activation feature.

20. An apparatus comprising:

a foldable material comprising a first portion and a second portion, the second portion at least partially surrounding the first portion;

an inner connection structure; and an outer connection structure, wherein the inner connection structure is configured to rotate relative to the outer connection structure; at least part of the first portion of the foldable material is attached to the inner connection structure and at least part of the second portion of the foldable material is attached to the outer connection structure; and the foldable material changes shape when the inner connection structure rotates relative to the outer connection structure; and wherein the inner connection structure has a rotational range of motion from a first position to a second position, the inner connection structure is configured to rotate from the second position to the first position in a first direction, the inner connection structure is configured to rotate from the first position to the second position in a second direction; and wherein the first portion of the foldable material is attached to an end of the inner connection structure, and the inner connection structure is recessed relative to the outer connection structure such that a recessed region exists at the end of the inner connection structure, and the first portion is drawn into the recessed region when the inner connection structure is rotated in the first direction.

21. The apparatus of claim 20, wherein the apparatus is a reveal feature on a toy, and the first portion comprises a fanciful design configured to be revealed by rotating the inner connection structure relative to the outer connection structure.

22. An apparatus comprising:

a foldable material comprising a first portion and a second portion, the second portion at least partially surrounding the first portion;

an inner connection structure; and an outer connection structure, wherein the inner connection structure is configured to rotate relative to the outer connection structure; at least part of the first portion of the foldable material is attached to the inner connection structure and at least part of the second portion of the foldable material is attached to the outer connection structure; and the foldable material changes shape when the inner connection structure rotates relative to the outer connection structure; and wherein the inner connection structure has a rotational range of motion from a first position to a second position, the inner connection structure is configured to rotate from the second position to the first position in a first direction, the inner connection structure is configured to rotate from the first position to the second position in a second direction; and wherein the foldable material changes shape by folding, the foldable material folds to form one or more folds only when the inner connection structure is not at the second position, and the foldable material does not comprise any folds when the inner connection structure is at the second position.

23. The apparatus of claim 22, wherein the apparatus is a reveal feature on a toy, and the first portion comprises a fanciful design configured to be revealed by rotating the inner connection structure relative to the outer connection structure.

24. An apparatus comprising:

a foldable material comprising a first portion and a second portion, the second portion at least partially surrounding the first portion;

an inner connection structure; and an outer connection structure, wherein the inner connection structure is configured to rotate relative to the outer connection structure; at least part of the first portion of the foldable material is attached to the inner connection structure and at least part of the second portion of the foldable material is attached to the outer connection structure; and the foldable material changes shape when the inner connection structure rotates relative to the outer connection structure; and wherein the inner connection structure comprises a rod mechanically coupled to a driving mechanism;

the outer connection structure comprises a sidewall that extends along a longitudinal axis, and a curved surface at one end of the sidewall;

the curved surface defines a central region, and the curved surface has a tangent that is perpendicular to the sidewall;

the rod extends into the central region of the curved surface and is recessed from the tangent;

the foldable material contacts the curved surface;

the outer portion of the foldable material is attached to the sidewall; and the inner portion of the foldable material is attached to the rod.

25. An apparatus comprising:

a foldable material comprising a first portion and a second portion, the second portion at least partially surrounding the first portion, and the first portion comprising a reveal feature that is visible when the first portion of the foldable material is in an unfolded state and that is not visible when the first portion of the foldable material is in a folded state;

an inner connection structure; and an outer connection structure, wherein the inner connection structure is configured to rotate relative to the outer connection structure; at least part of the first portion of the foldable material is attached to the inner connection structure; at least part of the second portion of the foldable material is attached to the outer connection structure at least at one connection point that does not move relative to the outer connection structure; the inner connection structure has a rotational range of motion; the at least part of the second portion of the foldable material that at least partially surrounds the first portion of the foldable material remains attached to the outer connection structure at the at least one connection point when the inner connection structure rotates through the rotational range of motion, and the first portion of the foldable material transitions from the folded state to an unfolded state such that the reveal feature is visible in response to rotation of the inner connection structure through the rotational range of motion in a first direction, wherein the apparatus is a replica eye for a toy, the first portion is a pupil portion, and the second portion is an iris portion.

26. The apparatus of claim 25, wherein the first portion of the foldable material extends substantially perpendicular to the inner connection structure when in the unfolded state.

* * * * *